US006949704B2

(12) United States Patent
Funaki

(10) Patent No.: US 6,949,704 B2
(45) Date of Patent: Sep. 27, 2005

(54) APPARATUS FOR DELIVERING MUSIC PERFORMANCE INFORMATION VIA COMMUNICATION NETWORK AND APPARATUS FOR RECEIVING AND REPRODUCING DELIVERED MUSIC PERFORMANCE INFORMATION

(75) Inventor: Tomoyuki Funaki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 260 days.

(21) Appl. No.: 10/180,791

(22) Filed: Jun. 25, 2002

(65) Prior Publication Data

US 2003/0000369 A1 Jan. 2, 2003

(30) Foreign Application Priority Data

Jun. 27, 2001 (JP) ..... 2001-194604
Jul. 10, 2001 (JP) ..... 2001-209069
Aug. 6, 2001 (JP) ..... 2001-237603

(51) Int. Cl.[7] ..... A63H 5/00; G04B 13/00; G10H 7/00

(52) U.S. Cl. ..... 84/609; 709/231

(58) Field of Search ..... 84/600, 601, 609; 434/307 A; 709/231

(56) References Cited

U.S. PATENT DOCUMENTS 5,810,603 A 9/1998 Kato et al.
6,700,049 B2 * 3/2004 Togashi ..... 84/609
2001/0049641 A1 * 12/2001 Nakamura et al. ..... 705/26
2002/0019743 A1 * 2/2002 Nakamura ..... 705/1
2002/0026867 A1 * 3/2002 Hasegawa et al. ..... 84/609
2002/0065880 A1 * 5/2002 Hasegawa et al. ..... 709/203
2002/0116614 A1 * 8/2002 Shibasaki ..... 713/168
2002/0194264 A1 * 12/2002 Uchiyama et al. ..... 709/203
2003/0055516 A1 * 3/2003 Gang et al. ..... 700/94

* cited by examiner

*Primary Examiner*—Jeffrey W Donels
(74) *Attorney, Agent, or Firm*—Morrison & Foerster LLP

(57) ABSTRACT

A plurality of client apparatus are individually connectable to a server apparatus via a communication network at any desired time. The server apparatus automatically selects suitable performance information from its own database, and delivers the thus-selected performance information to each of the client apparatus currently connected to the server apparatus. User of each of the client apparatus can request a desired music piece from the server apparatus. The user-requested music piece is selected by the server apparatus in accordance with a predetermined priority order and interleaved or incorporated between the automatically-selected music pieces, so that the incorporated user-requested music piece is delivered to the client apparatus along with the automatically-selected music pieces. In requesting a desired music piece, the user can impart the music piece with additional information such as desired texts and images. The additional information is delivered to the client apparatus along with the performance information of the user-requested music piece.

30 Claims, 13 Drawing Sheets

APPARATUS FOR DELIVERING MUSIC PERFORMANCE INFORMATION VIA COMMUNICATION NETWORK AND APPARATUS FOR RECEIVING AND REPRODUCING DELIVERED MUSIC PERFORMANCE INFORMATION

BACKGROUND OF THE INVENTION

The present invention relates generally to apparatus for delivering or distributing music piece performance information to a number of users via a communication network and apparatus for receiving and reproducing delivered music performance information. Particularly, the present invention relates to an improved music piece performance information delivery apparatus and music piece performance information reception/reproduction apparatus which allow many users to readily enjoy same music pieces at the same time and enjoy many music pieces in succession, as well as computer programs to be used in such music piece performance information delivery apparatus and music piece performance information reception/reproduction apparatus. Further, the present invention relates to an improved music piece performance information delivery apparatus and music piece performance information reception/reproduction apparatus which allow a user to enjoy his or her request music with priority over other music pieces. Furthermore, the present invention relates to an improved music piece performance information delivery apparatus and music piece performance information reception/reproduction apparatus which, when a music piece requested by a user is audibly reproduced, permit presentation of additional information imparted to the requested music piece by the user.

With the recent development of communication networks such as the Internet, every interested person can listen to a desired music piece via such a communication network in any place and at any desired time. For example, a user of a client terminal apparatus (hereinafter called a "client apparatus"), such as a personal computer or PDA (Personal Data (or Digital) Assistant), can enjoy a desired music piece by using the client apparatus to access a desired WWW (World Wide Web) server by way of a communication network, such as the Internet, and can thereby selectively receive the desired music piece from among a multiplicity of music pieces stored in the accessed WWW server.

However, each time the user of the client apparatus wants to enjoy desired music pieces via the Internet or other communication network as mentioned above, it has heretofore been necessary for the user to directly designate the desired music pieces, one by one, to the WWW server. Thus, it has not been easy to make settings such that a plurality of music pieces can play in succession, without a break, as a kind of background music. Namely, even when the user wants to listen to two or more music pieces in succession, he or she has to select the music pieces one by one. Repeating such designating or selecting operation for each of the music pieces tends to be disadvantageously very bothersome and inconvenient. Further, the conventionally-known technique, which is arranged to merely allow each interested user to select a desired music piece and enjoy the selected music piece only personally, would never enable many interested users to enjoy same music pieces at the same time.

SUMMARY OF THE INVENTION

In view of the foregoing, it is an object of the present invention to provide a music-piece-performance-information delivering server apparatus and music-piece-performance-information receiving/reproducing client apparatus which allow each interested user to enjoy music pieces in succession for a desired time through only simple user operation and allow many users to enjoy same music pieces at the same time.

It is another object of the present invention to provide a music-piece-performance-information delivering server apparatus and music-piece-performance-information receiving/reproducing client apparatus which, via a communication network, can accept a request for a music piece from each interested user and allow the user to enjoy the requested music piece with priority over other music pieces.

It is still another object of the present invention to provide a music-piece-performance-information delivering server apparatus and music-piece-performance-information receiving/reproducing client apparatus which, when a music piece requested by a user via a communication network is reproduced, permit presentation of additional information imparted to the requested music piece by the user.

According to a first aspect of the present invention, there is provided a server apparatus for delivering music performance information to a client apparatus connected thereto via a communication network, which comprises: a memory storing performance information of a plurality of music pieces; and a processor coupled with the memory. In this server apparatus, the processor is adapted to: automatically select performance information from the memory; identify a client apparatus currently connected to the server apparatus via the communication network and set the identified client apparatus as a transmission destination of performance information; and deliver, via the communication network, the automatically-selected performance information to the client apparatus having been set as the transmission destination. As an example, the processor may sequentially select performance information of two or more music pieces from the memory and, in accordance with the sequential selection of the performance information from the memory, successively deliver the same performance information of two or more music pieces to a plurality of client apparatus currently connected via the communication network to the server apparatus. Here, the successive delivery, to the individual client apparatus, of the performance information of two or more music pieces is initiated at respective time points when the connections of the individual client apparatus to the server apparatus are established.

The present invention also provides a client apparatus that corresponds to the server apparatus embodying the first aspect of the present invention. The client apparatus, which capable of receiving music performance information from the server apparatus via the communication network, comprises: a processor adapted to be coupled to the communication network, the processor being further adapted to: transmit a connection start request to a desired server apparatus on the communication network and establish a connection with the desired server apparatus via the communication network; receive performance information of two or more music pieces, in succession, from the desired server apparatus with which the connection has been established; and transmit a connection end request to the desired server apparatus to thereby terminate the connection with the desired server apparatus; and a reproduction device that reproduces a music performance on the basis of the performance information received from the desired server apparatus, wherein music performances are reproduced successively by the client apparatus, on the basis of performance information received from a server apparatus, over a time period from a time point when a connection of the client apparatus to the server apparatus is initiated or established to a time point when the connection of the client apparatus to the server apparatus is terminated.

According to the invention thus arranged, by performing only simple operation to connect his or her client apparatus to the server apparatus, a user of the client apparatus can enjoy listening to music successively as long as the client apparatus is connected with the server apparatus. From the time when the individual client apparatus are connected to the server apparatus onward, the server apparatus can successively deliver or distribute music piece performance information to all of the client apparatus connected thereto via the communication network. Thus, by performing only simple operation on the client apparatus, the user of each of the client apparatus allows music to continue playing, without a break, via the client apparatus. Further, because selected music piece performance information is delivered or distributed to the client apparatus connected to the server apparatus via the communication network, many users in different places can simultaneously enjoy same music.

According to a second aspect of the present invention, there is provided a server apparatus for delivering music performance information to a client apparatus connected thereto via a communication network, which comprises: a memory storing performance information of a plurality of music pieces; and a processor coupled with the memory. In this case, the processor is adapted to: automatically select performance information of two or more music pieces from the memory; accept a request for a music piece from a client apparatus connected to the server apparatus via the communication network; incorporate or interleave the request-accepted music piece between the automatically-selected music pieces in accordance with a predetermined priority order, and select performance information of the interleaved or incorporated request-accepted music piece from the memory; identify a client apparatus currently connected to the server apparatus via the communication network and set the identified client apparatus as a transmission destination of performance information; and deliver, via the communication network, the automatically-selected performance information and performance information of the request-accepted music piece, selected from the memory, to the client apparatus having been set as the transmission destination.

The present invention also provides a client apparatus that corresponds to the server apparatus embodying the second aspect of the present invention. The client apparatus, which is capable of receiving music performance information from the server apparatus via the communication network, comprises: an input section adapted to be used by a user of the client apparatus to request a desired music piece; a processor coupled with the input section and adapted to: transmit a connection start request to a desired server apparatus on the communication network and establish a connection with the desired server apparatus via the communication network; transmit a request for a music piece, made via the input section, to the desired server apparatus with which the connection has been established; receive performance information of two or more music pieces, in succession, from the desired server apparatus; and transmit a connection end request to the desired server apparatus to thereby terminate the connection with the desired server apparatus; and a reproduction device that reproduces a music performance on the basis of the performance information received from the desired server apparatus. In this case, the performance information received from the desired server apparatus includes performance information of request music pieces including a music piece requested by another user; the performance information of the request music pieces is one having been delivered by the server apparatus with priority over other performance information. Here, music performances are reproduced successively by the client apparatus, on the basis of performance information received from the server apparatus, over a time period from a time point when a connection of the client apparatus to the server apparatus is initiated or established to a time point when the connection of the client apparatus to the server apparatus is terminated.

With the invention thus arranged, the user of the client apparatus can request a desired music-piece-performance-information delivering server apparatus to deliver his or her desired music piece with priority over other music pieces, in the case where the user wants to successively enjoy music as long as the client apparatus is connected to the server apparatus via the communication network. Thus, where the user wants music to continue playing on his or her client apparatus, the user can cause a desired music piece to play with priority over other music pieces, by making a request for the desired music piece. At the same time that the performance information of a music piece requested by a given user of one client apparatus is delivered via the communication network, that performance information is also delivered to a user of another client apparatus.

According to a third aspect of the present invention, there is provided a server apparatus for delivering music performance information to a client apparatus connected thereto via a communication network, which comprises: a memory storing performance information of a plurality of music pieces; and a processor coupled with the memory. In this case, the processor is adapted to: accept a request for a music piece and additional information of the music piece transmitted from a client apparatus connected to the server apparatus via the communication network; select performance information of the request-accepted music piece from the memory; impart the additional information, having been accepted along with the request, to the selected performance information of the requested music piece identify a client apparatus currently connected to the server apparatus via the communication network and set the identified client apparatus as a transmission destination of performance information; and deliver, via the communication network, the selected performance information and the additional information imparted thereto to the client apparatus having been set as the transmission destination.

The present invention also provides a client apparatus that corresponds to the server apparatus embodying the third aspect of the present invention. The client apparatus, which is capable of receiving music performance information from the server apparatus via the communication network, comprises: an input section adapted to be used by a user of the client apparatus to request a desired music piece and enter additional information of the desired music piece; and a processor coupled with the input section and adapted to: transmit a connection start request to a desired server apparatus on the communication network and establish a connection with the desired server apparatus via the communication network; transmit a request for the desired music piece, made via the input section, to the desired server apparatus, along with the additional information entered via the input section; receive performance information of two or more of music pieces, in succession, from the desired server apparatus; and transmit a connection end request to the desired server apparatus to thereby terminate the connection with the desired server apparatus; a reproduction device that reproduces a music performance on the basis of the performance information received from the desired server apparatus; and an information presentation device that presents contents of the additional information received from the desired server apparatus. As an example, when the additional information includes at least one of text information and image information, the information presentation device visually displays the contents of the at least one of text information and image information, but when the additional information is in the form of sound information, the information presentation device audibly presents the contents of the sound information.

According to the invention thus arranged, in the case where the user of the client apparatus wants to receive music performance information from the server apparatus to enjoy listening to the music performance, the user can not only request the server apparatus to deliver his or her desired music piece with priority over other music pieces, but also enter desired additional or accessory information in correspondence with the requested music piece. In delivering requested music pieces to all client apparatus connected to the server apparatus via the communication network, the server apparatus delivers not only the performance information of the requested music pieces but also the additional information accepted along with the requests, so that each of the users can enjoy the music pieces requested by both that user and the other users. Also, each of the users can enjoy user-specific additional information, imparted by the individual users, in the form of texts, images, sounds, etc.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF THE EMBODIMENTS

Figure 1:
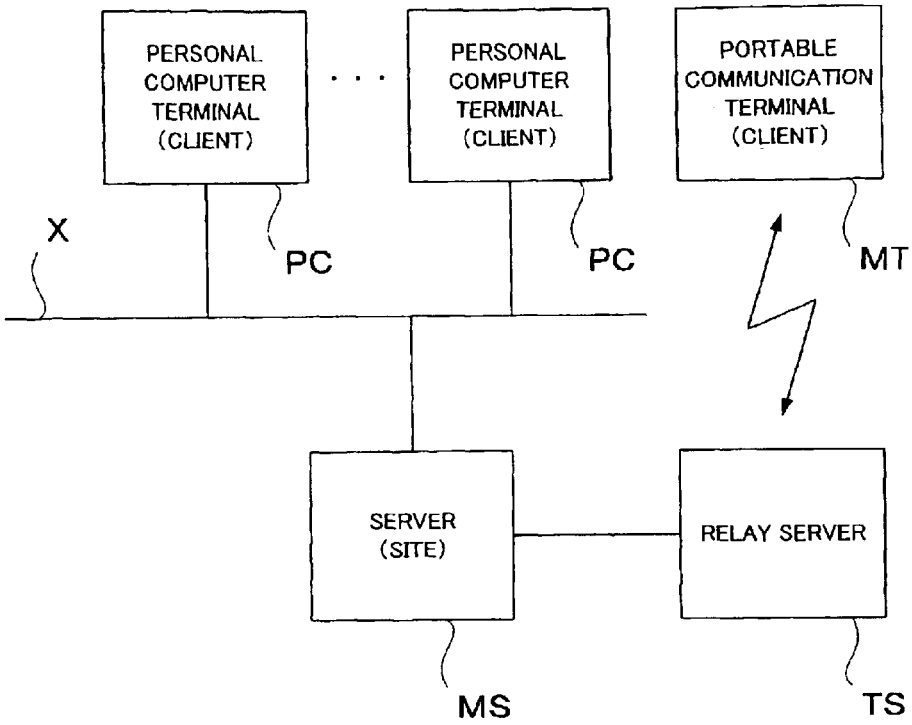
FIG. 1 is a system block diagram showing an exemplary general setup of a music piece performance information delivery system including a music-piece-performance-information delivering server apparatus and music-piece-performance-information reproducing client apparatus in accordance with a first embodiment of the present invention.

FIG. 1 is a system block diagram showing an exemplary general setup of a music piece performance information delivery system in accordance with a first embodiment of the present invention. This music piece performance information delivery system of FIG. 1 comprises at least one music-piece-performance-information delivering server apparatus (hereinafter referred simply as a server apparatus) MS, relay server apparatus TS, communication network X, and music-piece-performance-information reproducing client apparatus (hereinafter referred simply as a client apparatus) such as a personal computer terminal PC and portable communication terminal MT. As will be later described in detail, each of the above-mentioned information communication apparatus (i.e., the server apparatus MS, relay server apparatus TS, personal computer terminal PC and portable communication terminal MT) constituting the music piece performance information delivery system comprises an independent computer including a CPU, ROM, RAM, communication interface, etc. Thus, the information communication apparatus in the music piece performance information delivery system can communicate various information and data (e,g., HTML file, URL and music piece performance information) with each other via the communication network X, such as the Internet or dedicated line, or wireless communication. Via the existing communication network X, the music piece performance information delivery system shown in FIG. 1 allows a user of the client apparatus to use a well-known network browser or other predetermined software program to select a desired music distributing site from among a plurality of sites that are stored in the server apparatus MS for presenting various information, data, etc. in predetermined display styles. Then, the client apparatus automatically receives music piece performance information, such as MIDI data or audio data, from the selected music distributing site (server apparatus MS) and sounds or audibly reproduces the music piece performance information.

Although the music piece performance information delivery system implementing the present invention may include other hardware than the above-mentioned, it will be described hereinafter in relation to a case where minimum necessary resources are employed in the system.

Each of the client apparatus, such as the personal computer terminal PC and potable communication terminal MT, can access any desired one of the sites stored in the server apparatus MS in accordance with a user's access request (e.g., designation of a URL (Uniform Resource Locator)). For example, each of the sites stored in the server apparatus MS on the communication network X is managed as an HTML (Hyper Text Markup Language) files that are display information forming a basis for creation of a plurality of Web pages described by an HTML program. Each of the HTML files is imparted with an URL indicative of a unique network address on the communication network X. For example, the URL is an Internet address to be used to designate an HTML file stored in a given server apparatus MS and is made up of a string of predetermined characters. The client apparatus reads out a user-desired HTML file from the server apparatus MS by designating the URL of the desired HTML file and displays the site on the basis of the read-out HTML file. The way of displaying the site on the basis of the HTML file is well known and hence will not be described here. As the client apparatus accesses a desired music distributing site from among a multiplicity of sites in the server apparatus MS, it automatically receives music piece performance information transmitted from the server apparatus MS having the accessed site stored therein, and performs a process for generating audible tones of a music piece on the basis of the received music piece performance information, as will be later described in detail.

Each of the server apparatus MS, constituting the music piece performance information delivery system along with the above-described client apparatus, is a server computer that has prestored therein a multiplicity of HTML files to be used for display, in the client apparatus, of selected sites and a multiplicity of items of music piece performance information and that performs various processes including those for transmitting, to the client apparatus, HTML files related to a selected site and selected music piece performance information in response to an access request (e.g., designation of an URL) from the client apparatus to the selected site. Namely, in the music piece performance information delivery system of the present invention, the server apparatus MS is connected with the client apparatus via the communication network X, such as the Internet or dedicated line, or wireless communication, and, in response to an access request from the connected client apparatus, reads out not only HTML files but also music piece performance information automatically selected by the server apparatus MS. The server apparatus MS transmits the thus read-out HTML files and music piece performance information to the client apparatus. The music piece performance information prestored in the server apparatus MS is designed to be used as control information for generating tones of the music piece, which includes, for example, event data and duration data.

Each of the portable communication terminals MT, such as a cellular phone and PDA (Personal Data (Digital) Assistant), is a small-sized terminal capable of wired and wireless communication and has, in addition to the primary communication function, a site display function and tone generation function for generating audible tones of a selected music piece. Namely, each of the portable communication terminals MT is provided with a predetermined display device capable of displaying a user-desired music distributing site and a tone generator circuit and sound system for generating audible tones of a selected music piece on the basis of music piece performance information received from a desired one of the server apparatus MS. When bidirectional communication is to be performed by connecting such a communication terminal MT to the desired server apparatus MS, the relay station TS has to intervene. The relay station TS relays transmission/reception of various signals between the portable communication terminal MT and the server apparatus MS so that the portable communication terminal MT can access the desired server apparatus MS through the intervention of the relay station TS.

Note that the client apparatus may be in the form of other equipment than the above-described personal computer terminal PC or portable communication terminal MT, as long as they can acquire an HTML file and music piece performance information from a desired one of the server apparatus and process the acquired HTML file and music piece performance information. Further, in the first embodiment of FIG. 1, a plurality of the client apparatus, such as the personal computer terminal PC and portable communication terminal MT, and a plurality of the servers MS may of course be connected to the communication network X. Further, whereas the first embodiment of FIG. 1 has been described above in relation to the case where a desired site is displayed on the basis of an HTML file, it may be designed to display a desired site on the basis of another similar file (e.g., one based on the Java language or the like).

As noted earlier, the server apparatus MS and the client apparatus are connected with each other via the communication network X such as a LAN (Local Area Network) or wireless communication; thus, by connecting the client apparatus to the communication network X for bidirectional communication with the server apparatus MS, the user of the client apparatus can read a desired site stored in the server apparatus MS and fetch desired data etc. from the server apparatus MS to the client apparatus. Particularly, when the client apparatus has accessed a predetermined music distributing site, it automatically receives music piece performance information and audibly reproduces a music piece on the basis of the received music piece performance information.

Figure 2:
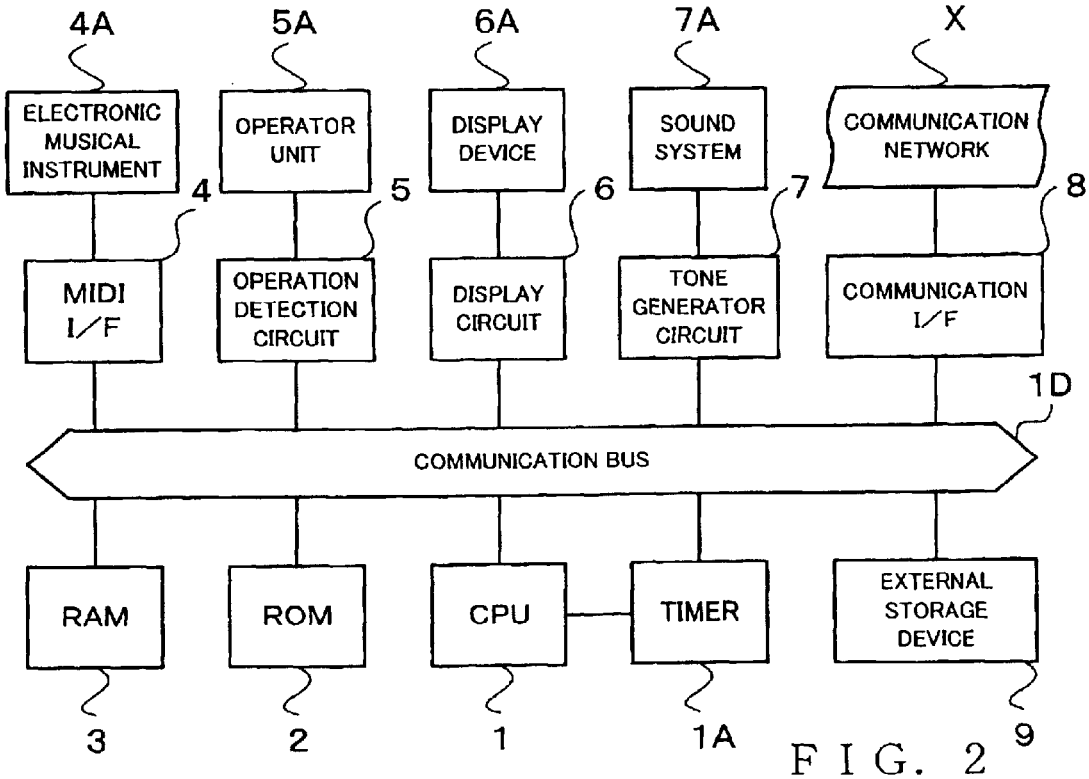
FIG. 2 is a block diagram showing an exemplary hardware setup of one of the apparatus constituting the first embodiment of the music piece performance information delivery system of FIG. 1.

The general hardware setups of the personal computer terminal PC, portable communication terminal MT, server apparatus MS and relay server apparatus TS are constructed similarly to each other, and thus the hardware setup of just one of the personal computer terminal PC, portable communication terminal MT, server apparatus MS and relay server apparatus TS will hereinafter be outlined representatively with reference to FIG. 2. Specifically, FIG. 2 is a block diagram showing an exemplary hardware setup of the personal computer terminal PC.

The personal computer terminal PC in the first embodiment of the music piece performance information delivery system is controlled by a microcomputer comprising a microprocessor unit (CPU) 1, a read-only memory (ROM) 2 and a random-access memory (RAM) 3. The CPU 1 controls all operations of the entire personal computer terminal PC. To the CPU 1 are connected, via a data and address bus (communication bus) 1D, the ROM 2, RAM 3, MIDI interface (I/F) 4, operation detection circuit 5, display circuit 6, tone generator circuit 7, communication interface (I/F) 8 and external storage device 9. Also connected to the CPU 1 is a timer 1A for counting various time periods, for example, to signal interrupt timing for timer interrupt processing. Namely, the timer 1A generates tempo clock pulses for counting time intervals or setting a performance tempo with which a music piece is to be audibly reproduced or played on the basis of music piece performance information received from the server apparatus MS. The frequency of the tempo clock pulses is adjustable, for example, via a tempo setting switch on an operator unit 5A. Such tempo clock pulses generated by the timer 1A are given to the CPU 1 as processing timing instructions or as interrupt instructions. The CPU 1 carries out various processes in accordance with such instructions from the timer 1A.

The ROM 2 has prestored therein various information and programs to be executed by the CPU 1 and various data to be referred to by the CPU 1. The RAM 3 is used as a working memory not only for temporarily storing various information, such as HTML files, and music piece performance information (and additional information), received from the server apparatus MS or the like, but also for storing various data generated as the CPU 1 executes the programs. The RAM 3 is also used as a memory for storing the currently-executed program and data related thereto. Predetermined address regions of the RAM 3 are allocated to various functions and used as registers, flags, tables, memories, etc. For example, when music piece performance information has been received from the server apparatus MS, it is temporarily stored in the RAM 3 of the personal computer terminal PC.

The MIDI interface (I/F) 4 is provided for receiving and delivering MIDI music piece performance information (MIDI data) from and to an electronic musical instrument 4A or the like. Note that the electronic musical instrument 4A may be of any type (or operating type), such as the keyboard type, guitar type, wind instrument type, percussion instrument type or gesture type, as long as it can generate MIDI data in response to manipulations by the user of the personal computer terminal PC. Note that the MIDI interface 4 may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface 4, the electronic musical instrument 4A is designed to communicate other data than MIDI event data. Of course, the music piece performance information handled in the instant embodiment may be of any other data format than the MIDI format, in which case the MIDI interface 4 and electronic musical instrument 4A are constructed in conformity to the data format used.

In the case where the tone generator circuit 7 is provided within the personal computer terminal PC, the aforementioned MIDI interface 4 and electronic musical instrument 4A may be dispensed with. Namely, the client apparatus may be provided with at least one device capable of audibly reproducing a music piece on the basis of music piece performance information.

The panel operator unit 5A may preferably comprise a combination of a mouse (point-and-click device) and keyboard or special switch unit connected to the body of the personal computer terminal PC; note, however, that the panel operator unit 5A may be of any other suitable type. For example, the operator unit 4A may be in the form of a combination of a ten-button keypad for manual entry of numeric value data and keyboard for manual entry of character data such as a URL, or panel switches. The operation detection circuit 5 constantly detects respective operational states of the individual operators on the operator unit 5A and outputs switch information, corresponding to the detected operational states of the operators, to the CPU 1 via the communication bus (e.g., data and address bus) 1D. The display circuit 6 visually displays, on a display device 6A such as a liquid crystal display (LCD) panel or CRT (Cathode Ray Tube), not only a site but also contents of music piece performance information received from the server apparatus MS and a musical score of a music piece reproduced on the basis of the received music piece performance information. The display circuit 6 also displays controlling states of the CPU 1 on the display device 6A. Further, where additional information is imparted to the music piece performance information, the display circuit 6 can display detailed contents of the additional information on the display device 6A.

The tone generator (T.G.) circuit 7, which is capable of simultaneously generating a plurality of tone signals in a plurality of channels, receives music piece performance information supplied via the communication bus (e.g., data and address bus) 1D, such as one delivered from the server apparatus MS and temporarily stored in the RAM 3, and generates tone signals on the basis of the received music piece performance information. Each of the tone signals thus generated by the tone generator circuit 7 is audibly reproduced or sounded by a sound system 7A including amplifiers and speakers. The music piece performance information to be received from the server apparatus MS may be either in a digitally-encoded format such as the MIDI format or in a waveform sample data format such as the PCM, DPCM or ADPCM. The tone generator circuit 7 and sound system 7A may be constructed in any desired conventional manner.

Further, the communication interface (I/F) 8 is connected to the communication network X, such as a LAN, Internet or telephone line network, via which it can be connected to a desired server apparatus MS or the like. Thus, with the communication interface 8, the personal computer terminal PC can transmit a request for any of various data to the server apparatus MS and receive, from the server apparatus MS, HTML files related to a desired music distributing site and music piece performance information (and additional information) being delivered by a desired music distributing site. Namely, the personal computer terminal PC transmits, to the server apparatus MS via the communication network 8 and communication network X, a command to request downloading, from the server apparatus MS, of HTML files related to a desired music distributing site so that the desired music distributing site can be displayed in the terminal PC. In response to the request from the personal computer terminal PC, the server apparatus MS delivers the requested HTML files to the personal computer terminal PC and transmits music piece performance information being delivered by the desired music distributing site, via the communication network 8 and communication network X. Then, the personal computer terminal PC receives the requested HTML files and music piece performance information, so that it performs processes for displaying the desired site on the basis of the received HTML files, generating audible tones of a music piece on the basis of the received music piece performance information, etc.

It should be appreciated that the communication interface 8 and communication network X may be of either or both of wired and wireless types.

The external storage device 9 is provided for storing an HTML file and music piece performance information, or data such as those pertaining to control of various programs to be executed by the CPU 1, etc. Where a particular control program is not prestored in the ROM 2, the particular control program may be prestored in the external storage device (e.g., hard disk device) 9, so that, by reading the control program from the external storage device 9 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 9 may use any one or combination of various removable-type storage media other than the hard disk (HD), such as a floppy disk (FD), compact disk (CD-ROM, CD-RAM or CD-RW), magneto-optical disk (MO), digital versatile disk (DVD) and semiconductor memory.

In the case of another type of the client apparatus, the portable communication terminal MT, the operator unit 5A is, for example, in the form of a given switchboard externally connected to or provided in the body of the terminal MT. Further, in the portable communication terminal MT, the display device 6A is, for example, in the form of a liquid crystal display externally connected to or provided in the body of the terminal MT. Further, it is preferable that the tone generator circuit 7 and sound system (e.g., amplifiers and speakers) 7A in the portable communication terminal MT be externally connected to or provided in the body of the terminal MT. Further, the communication interface 8 in the portable communication terminal MT is a device intended for wireless communication, which is capable of communicating with the relay server TS. Of course, the portable communication terminal MT may includes an interface to perform wired communication, similarly to the personal computer terminal PC. Furthermore, the external storage device 9 in the portable communication terminal MT may be either pre-installed in the body of the terminal MT or externally connected to the body of the terminal MT via a cable or the like. Where the external storage device 9 is pre-installed in the body of the terminal MT, it is preferable that the external storage device 9 be a small-size semiconductor memory drive. Where the external storage device 9 is externally connected to the body of the terminal MT, the device 9 may be any one or combination of various storage media other than the hard disk (HD), such as a floppy disk (FD), compact disk (CD-ROM, CD-RAM or CD-RW), magneto-optical disk (MO) and digital versatile disk (DVD).

Note that the above-described client apparatus, such as the personal computer terminal PC and portable communication terminal MT, and server apparatus MS need not necessarily include the above-described operator unit 5A, display device 6A and tone generator circuit 7, etc. together within the body of the apparatus; the operator unit 5A, display device 6A and tone generator circuit 7, etc. may be provided separately from each other but can be connected with each other via MIDI interfaces and communication facilities such as a communication network. Further, the client apparatus may be other than the personal computer terminal PC or portable communication terminal MT, such as an automatic performance apparatus like a karaoke apparatus or player piano or electronic musical instrument itself.

Further, each of the server apparatus MS and relay server apparatus TS need not necessarily includes the MIDI interface 4, electronic musical instrument 4A, tone generator circuit 7 and sound system 7A. Furthermore, in the server apparatus MS, a music piece performance information database may be constructed using the ROM 2, RAM 3 or external storage device 9, so as to prestore a multiplicity of pieces of music piece performance information.

Figure 3:
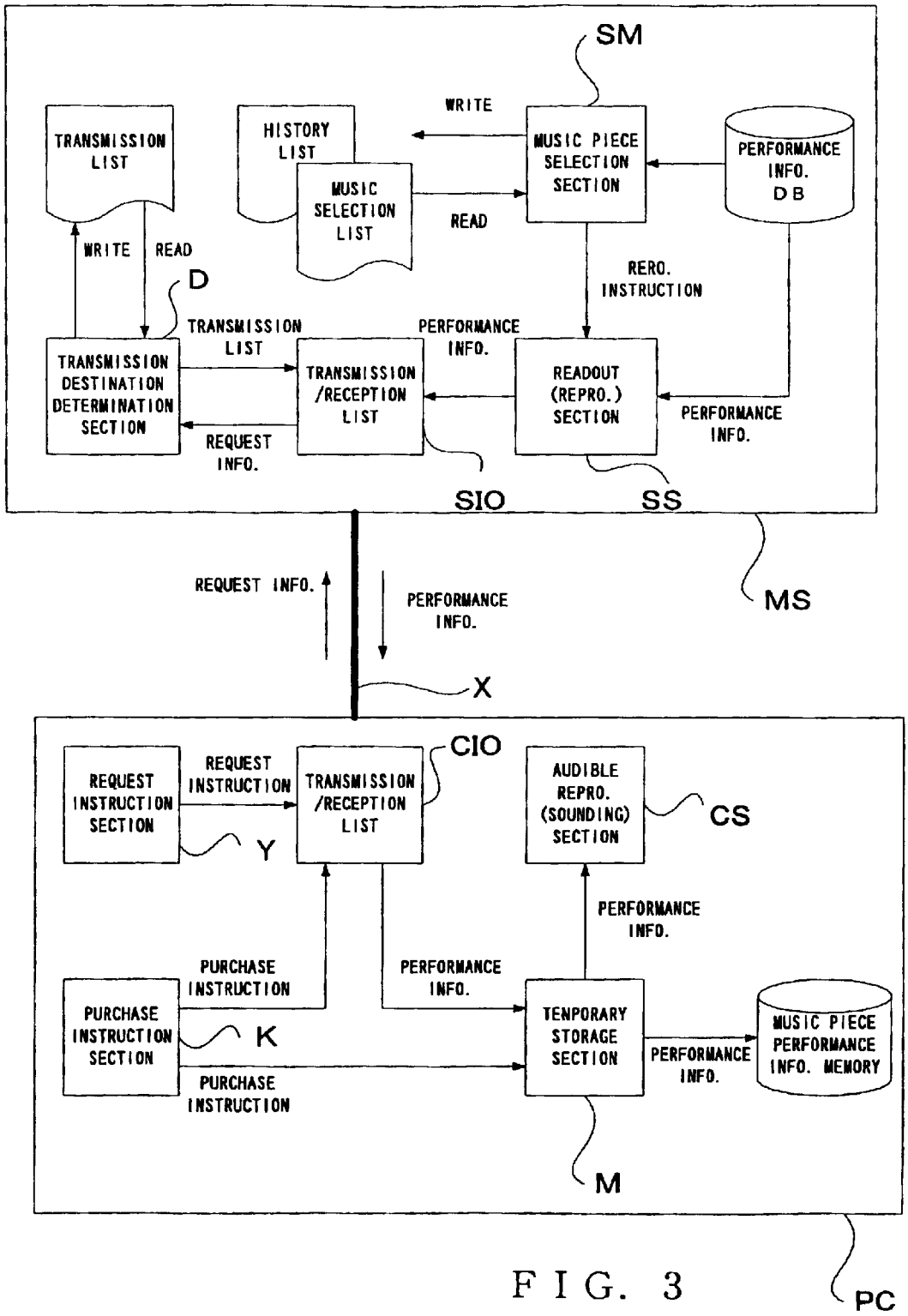
FIG. 3 is a functional block diagram explanatory of various functions performed by a personal computer terminal (client apparatus) and server apparatus in the first embodiment of the music piece performance information delivery system.

The following paragraphs describe the first embodiment of the present invention with reference to FIGS. 3 to 11. FIG. 3 is a functional block diagram explanatory of various functions performed by the personal computer terminal PC (client apparatus) and server apparatus MS in the first embodiment of the music piece performance information delivery system of FIG. 1. First, a brief description will be made about the various functions of the personal computer terminal PC (client apparatus).

In the personal computer terminal PC, a request instruction section Y has a function of instructing, via a transmission/reception section CIO of the personal computer terminal PC, the server apparatus MS to perform operations in response to a request made by the user; examples of such a request that can be given from the request instruction section Y to the server apparatus MS include a connection request to request a start of connection to the server apparatus MS storing a user-desired music distributing site, and a connection end request to request an end of connection to the server apparatus MS storing a user-desired music distributing site. Purchase instruction section K has a function of indicating to the server apparatus MS via the transmission/reception section CIO that the user of the personal computer terminal PC wants to purchase music piece performance information from the server apparatus MS, as well as a function of instructing rewriting of music piece performance information, temporarily stored in a temporary storage section M, into a music piece performance information memory. The temporary storage section M is a volatile memory for temporarily storing music piece performance information received from the server apparatus MS. Further, the temporary storage section M has a function of sending the temporarily-stored music piece performance information to an audible reproduction section CS every predetermined time, as well as a function of sending the temporarily-stored music piece performance information to the music piece performance information memory in response to a purchase request given by the purchase instruction section K. The music piece performance information memory is a non-volatile memory for storing music piece performance information.

The reproduction section CS of the personal computer terminal PC has a function of reproducing the music piece performance information, sent from the temporary storage section M, to generate audible tones of the music piece on the basis of the music piece performance information. The transmission/reception section CIO has a function of permitting communication of various information between the personal computer terminal PC and the server apparatus MS. Examples of the information transmitted from the transmission/reception section CIO to the server apparatus MS include a user ID and network address of the client apparatus, connection request, connection end request, purchase request and the like corresponding to instructions given by the user. Examples of the information which the transmission/reception section CIO receives from the server apparatus MS include music piece performance information etc. Note that the user ID is a unique character string imparted to each user in order to individually manage users utilizing the server apparatus MS by use of their respective personal computer terminals PC connected to the server apparatus MS. The network address is a unique identification number allocated in advance to each personal computer terminal PC in order to distinguish among the personal computer terminals PC connected to the communication network X.

The server apparatus MS has various functions as described below.

In the server apparatus MS, a transmission destination determination section D has a function of writing or deleting a user ID and transmission address (transmitted-from address) to or from a transmission list in accordance with request information (connection request or connection end request) received from the client apparatus (e.g., personal computer terminal PC) via a transmission/reception section SIO of the server apparatus MS. The transmission destination determination section D also has functions of reading out the transmission list and sending the read-out transmission list to the transmission/reception section SIO of the server apparatus MS. In the transmission list, there is recorded the address of the client apparatus (e.g., personal computer terminal PC) to which music piece performance information is to be transmitted. The server apparatus MS transmits music piece performance information only to the personal computer terminal PC corresponding to the address recorded in the transmission list. Music piece selection section SM selects a music piece to be added to a music piece selection list in accordance with a predetermined criterion with reference to a music piece performance information database (DB) having stored therein a multiplicity of items of music piece performance information imparted with respective IDs, and then the music piece selection section SM writes the music piece performance information ID of the selected music piece into the music piece selection list. Further, the music piece selection section SM has functions of reading out the music piece selection list, sending a music piece selection instruction to a readout section SS such that the readout section SS reads out, from the music piece selection list, music piece performance information corresponding to a music piece performance information ID read out from the music piece selection list and writing the ID of the selected music piece into a history list.

In response to the music piece selection instruction from the music piece selection section SM, the readout section SS reads out the corresponding music piece performance information and transmits the read-out music piece performance information only to the personal computer terminals PC having their addresses recorded in the transmission list. The transmission/reception section SIO has a function of permitting communication of various information between the personal computer terminal PC and the server apparatus MS. The information transmitted from the server apparatus MS to the personal computer terminal PC is music piece performance information, and examples of the information received from the personal computer terminal PC include a user ID and network address of the personal computer terminal PC, connection request, connection end request, purchase request and the like corresponding to instructions given by the user of the personal computer terminal PC. Namely, the music piece selection list records therein items of music piece performance information representative of a predetermined number of music pieces, which are to be transmitted to the personal computer terminal PC, in predetermined order of transmission, so that the server apparatus MS transmits, to the personal computer terminal PC, the items of music piece performance information in the order of transmission designated in the read-out music piece selection list. The history list records therein the items of music piece performance information having been transmitted in the transmitted order; that is, the history list records therein a transmission history of the items of music piece performance information having been transmitted from the server apparatus MS to the personal computer terminal PC. As an example of the music piece selection criterion, the music piece selection section SM makes reference to the history list to automatically pick up music pieces that fall within preset piece-to-piece interval limits (e.g., time interval represented by the number of music pieces and time length intervening between successive reproductions of a given music piece) and then write the IDs of some of the other music pieces than the picked-up music pieces into the music piece selection list. For example, in the instant embodiment, there is preset such piece-to-piece interval limits that define a time interval at which a same music piece is allowed to be performed next without causing inconveniences. The music piece selection section SM picks up, from among the music pieces recorded in the history list, those music pieces falling within the predetermined piece-to-piece interval limits, and then it writes any of the music pieces, other than the picked-up ones, stored in the music piece performance information database (DB) into the music piece selection list as new music pieces. With this arrangement, it is possible to prevent same music pieces from being frequently transmitted repeatedly from the server apparatus MS to the personal computer terminal PC. Of course, other suitable schemes than the above-described may be employed for that purpose. For example, music pieces may be automatically selected through a combination of random music piece selection and use of the predetermined piece-to-piece time interval limits. It should be obvious that the music piece selection list is updated as occasion arises, by deleting the IDs of already-delivered music pieces and adding the IDs of new music pieces.

The music piece performance information delivery in the present invention may be performed in either of the following two manners. As the first option, the server apparatus MS merely delivers only music piece performance information corresponding to a musical score (i.e., music performance information like MIDI performance information), and the personal computer terminal PC (client apparatus) carries out actual music piece reproduction/performance processing on the basis of the music piece performance information, delivered from the server apparatus MS, to generate sound signals of the music piece for audible reproduction of the music piece. As the second option, the server apparatus MS previously carries out music piece reproduction/performance processing, on the basis of music piece performance information corresponding to a musical score (i.e., music performance information like MIDI performance information), to generate sound signals of the music piece and then delivers the thus-generated sound signals to the personal computer terminal PC, so that the personal computer terminal PC audibly reproduces the delivered sound signals just as received from the server apparatus MS. The embodiment of FIG. 3 has been described above as employing the first option; namely, the personal computer terminal PC has been described as merely receiving only music piece performance information from the server apparatus MS and then reproducing the received music piece performance information to sound or play the music piece. Where the second option is taken, the readout section SS in the server apparatus MS performs both functions of reading out music piece performance information from the music piece performance information database DB and reproducing the read-out music piece performance information, and then transmits the reproduced music piece sound signals (audio data) to the personal computer terminal PC via the transmission/reception section SIO. Once the personal computer terminal PC receives the reproduced music piece sound signals (audio data) from the server apparatus MS, it directly stores the sound signals in the temporary storage section M, and the reproduction section CS of the personal computer terminal PC sounds or audibly reproduces the music piece sound signals. Namely, in this case, the reproduction section CS performs only the function of sounding the already-reproduced music piece sound signals; it does not perform the function of reproductively performing the music piece performance information (music performance information like MIDI performance information).

Next, a description will be made about various processes carried out by the personal computer terminal PC (client apparatus) and server apparatus MS in the music piece performance information delivery system of FIG. 1, namely, about various control programs executed by the respective CPUs 1 of the client apparatus, such as the personal computer terminal PC or portable communication terminal MT, and server apparatus MS. Specifically, the following paragraphs describe the control programs in relation to the case where the server apparatus MS merely delivers only music piece performance information and the client apparatus, such as the personal computer terminal PC or portable communication terminal MT, reproduces the delivered music piece performance information to sound the music piece. Although, in effect, the client apparatus having requested access to the server apparatus MS and the server apparatus MS carry out respective main processing in a parallel fashion while communicating predetermined information with each other, the main processing of the client apparatus and the main processing of the server apparatus MS will be described hereinbelow separately from each other to facilitate understanding.

Figure 4:
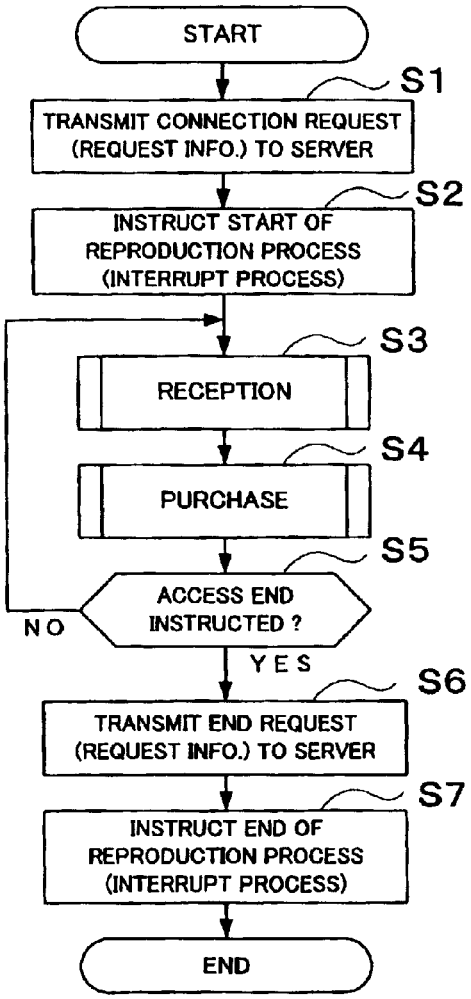
FIG. 4 is a flow chart showing an exemplary step sequence of main processing carried out by the client apparatus in the first embodiment of the music piece performance information delivery system.

First, various processes carried out by the client apparatus will be described. FIG. 4 is a flow chart showing an exemplary step sequence of the main processing carried out by the client apparatus in the first embodiment of the music piece performance information delivery system. In this main processing, site display, transmission/reception of predetermined music piece performance information and other processes are carried out between the client apparatus, such as the personal computer terminal PC or portable communication terminal MT, and the server apparatus MS. The main processing in the client apparatus is started up when a request has been made for connection to a desired site of the server apparatus MS while a network browser is in operation, namely, when access to the desired site has been initiated by use of the network browser, and this main processing is continued until the connection to the desired site is terminated.

At step S1, the user of the client apparatus performs operation to request the server apparatus MS for access to a desired music distributing site stored in the server apparatus MS. Among examples of the user operation that can be regarded as such an access request are user's direct entry, at a predetermined position of the network browser, of the URL of a desired music distributing site, and mouse-clicking on a desired music distributing site, e.g. from a listing of sites displayed on the display device 6A. In response to such user operation, the client apparatus transmits, to the server apparatus MS, request information to request connection to the server apparatus MS. The request information includes data indicative of a user ID and transmission address (transmitted-from address) as well as data indicative of the connection request. At step S2, a reproduction process (client reproduction process) is started, which is directed to reproducing music piece performance information received from the server apparatus MS and thereby audibly generates tones of the music piece. At next step S3, a reception process is carried out, which receives music piece performance information transmitted from the server apparatus MS. At following step S4, a purchase process is carried out for purchasing a desired music piece performance information from the server apparatus MS. These reproduction process, reception process and purchase process will be detailed later.

At step S5, a determination is made as to whether termination of the access to the server apparatus MS has been instructed or not. If answered in the negative (NO determination at step S5), the CPU 1 reverts to step S3 to repeat the operations of step S3 to S5. Namely, thus repeating the reception of the music piece performance information from the server apparatus MS can continue the reproduction of the music piece, and the music piece can be purchased at any time, as necessary, as long as the client apparatus is connected to the server apparatus MS. If, on the other hand, termination of the access to the server apparatus MS has been instructed (YES determination at step S5), the client apparatus transmits a connection end request to the server apparatus MS at step S6. The connection end request information to request termination of the connection to the server apparatus MS includes data indicative at least one of the user ID and transmission address, in addition to data indicative of the connection end request. Then, the server apparatus MS carries out a predetermined end process in response to the connection end request. At step S7, the reproduction process having been started at step S2 above is brought to an end. Namely, because the access or connection to the server apparatus MS has been terminated at step S6 above, no further music piece performance information is received for reproduction of a music piece, so that the reproduction process is brought to an end.

Figure 6:
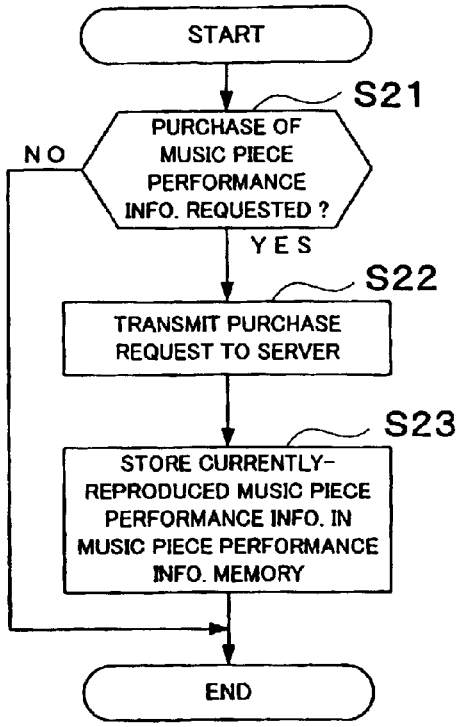
FIG. 6 is a flow chart showing an example of a purchase process of FIG. 4.
Figure 5:
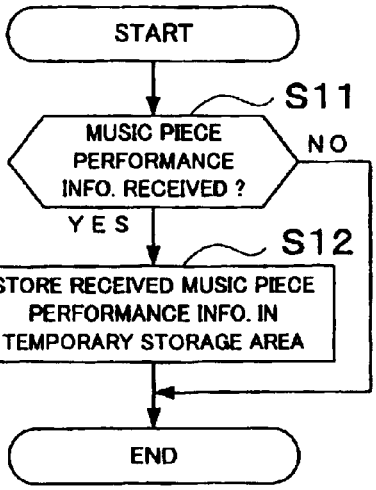
FIG. 5 is a flow chart showing an example of a reception process of FIG. 4.

The following paragraphs describe the details of the reception process and purchase process carried out at steps S3 and S4 of the client main processing shown in FIG. 4, with reference to flow charts of FIGS. 5 and 6.

First, an example of the reception process is explained more fully with reference to the flow chart of FIG. 5. At step S11, it is determined whether or not any music piece performance information has been received, i.e. whether any music piece performance information has been delivered by the server apparatus MS accessed on the basis of an access request from the client apparatus and has been received by the client apparatus. If no music piece performance information has been received from the server apparatus MS as determined at step S11, the reception process is brought to an end instantly without performing any other operation. If any music piece performance information has been received from the server apparatus MS (YES determination at step S11), the received music piece performance information is stored in a temporary storage area at step S12. If the music piece performance information reception by the client apparatus is via "streaming" delivery, the quantity of data corresponding to a data unit of several-minute duration contained in the music piece performance information is received by the client apparatus per delivery. If the music piece performance information reception by the client apparatus is via "downloading" delivery, the quantity of data corresponding to a data unit representative of a single music piece contained in the music piece performance information is received by the client apparatus per delivery. The music piece performance information temporarily stores each received data unit of the music piece performance information into the temporary storage area.

Next, an example of the purchase process is explained more fully with reference to the flow chart of FIG. 6. At step S21, a determination is made as to whether or not purchase of any music piece performance information has been requested by the user. If answered in the negative at step S21, the purchase process is brought to an end instantly without the client apparatus performing any other operation. If, on the other hand, purchase of any music piece performance information has been requested by the user (YES determination at step S21), the client apparatus transmits purchase request information to the server apparatus MS at step S22. The purchase request information includes data indicative of the user ID, ID of the music piece performance information being currently reproduced and way of billing as well as data indicative of the purchase request. The music piece performance information being currently reproduced is stored in the music piece performance information memory, at step S23. Namely, the client apparatus can purchase any user-desired music piece performance information that is being reproduced at the time when the purchase request is made. At that time, the music piece performance information being currently reproduced is normally searched for from the temporary storage area and then stored in the music piece performance information memory; however, in case a portion of the music piece performance information of the music piece in question has already been deleted from the temporary storage area, the deleted portion, i.e. lacking portion, is again acquired (re-obtained) from the server apparatus MS so that the complete music piece performance information of the music piece is stored in the music piece performance information memory. The music piece performance information memory is a storage area separate from the above-mentioned temporary storage area M, which stores only the music piece performance information purchased by the client apparatus. Namely, while the music piece performance information temporarily stored in the temporary storage area is automatically erased every predetermined timing, the music piece performance information stored in the music piece performance information memory is never erased unless the user intentionally performs operation for erasing it from the performance information memory. Namely, with the arrangement that the music piece performance information stored in the temporary storage area is automatically erased, the music piece performance information delivered from the server apparatus MS will be lost unless the music piece performance information is purchased through predetermined purchasing procedures (e.g., by paying a predetermined charge), as a result of which unfair use of the music piece performance information can be reliably prevented.

Figure 7:
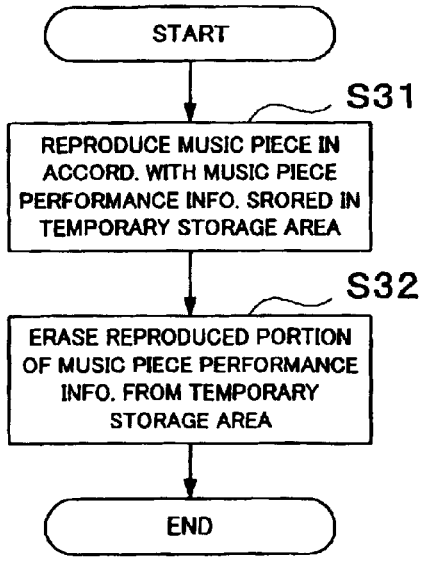
FIG. 7 is a flow chart showing an example of a reproduction process carried out by the client apparatus.

Next, with reference to a flow chart of FIG. 7, an example of the client reproduction process is described which is started up at step S2 of FIG. 4 and brought to an end at step S7. The reproduction process is an interrupt process that is triggered every predetermined timing corresponding to processing clock pulses of the client apparatus. Namely, the client reproduction process is activated interruptively during execution of the main processing, and it reads out the music piece performance information stored in the temporary storage area of the client apparatus and audibly reproduces the music piece on the basis of the read-out music piece performance information.

At step S31, the music piece is reproduced in accordance with the music piece performance information stored in the temporary storage area. At next step S32, as the music piece performance information already stored in the temporary storage area is read out to reproduce the music piece, the thus-reproduced portion of the music piece performance information is erased from the temporary storage area; this way, write and readout, to and from the temporary storage area, of the music piece performance information are controlled in the instant embodiment. In the case of the streaming delivery, the client apparatus receives, from the server apparatus MS, new music piece performance information, the predetermined data unit per delivery, and accumulates every received data unit of the music piece performance information in the temporary storage area, and it also sequentially erase the reproduced portion of the music piece performance information by the predetermined data unit. Thus, even when the delivered amount of music piece performance information from the server apparatus MS increases to a significant degree, it is possible to limit the music piece performance information to be stored in the temporary storage area below a predetermined amount.

It should be appreciated that each music piece to be reproduced may be based on either audio data or MIDI data. Further, music piece performance information may be reproduced on the basis of either the streaming delivery or the downloading delivery. Furthermore, deletion or erasure, from the temporary storage are, of music piece information representative of a music piece may be executed after the reproduction of the music piece is completed; in this way, the purchase process of the music piece (step S23 of FIG. 6) can be performed promptly.

Figure 8:
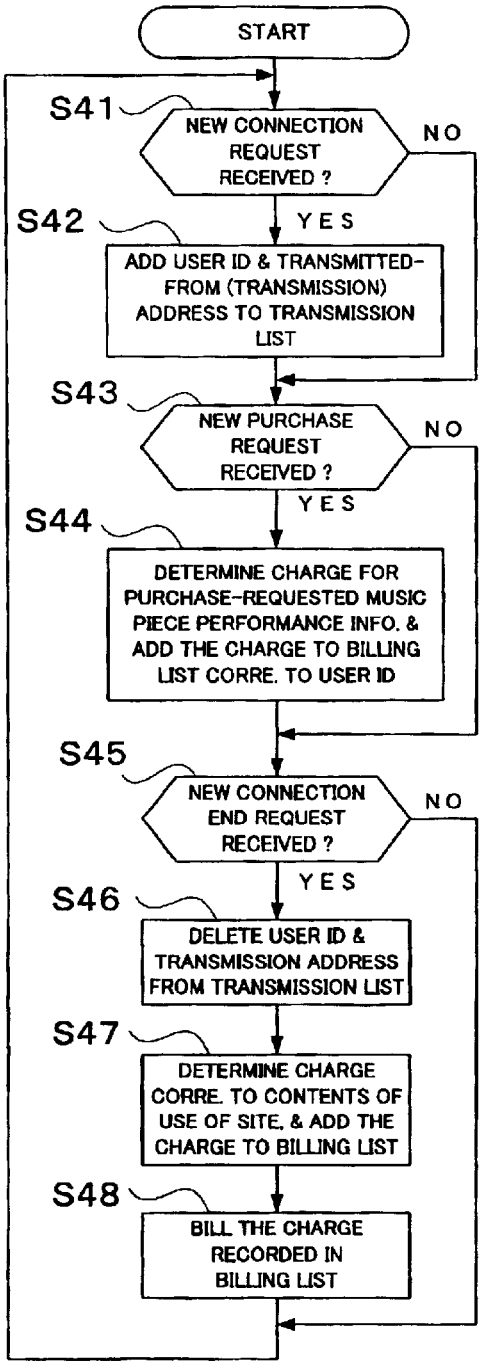
FIG. 8 is a flow chart showing an exemplary step sequence of main processing carried out by the server apparatus in the first embodiment of the music piece performance information delivery system.

The following paragraphs describe various processes carried out by the server apparatus MS. FIG. 8 is a flow chart showing an exemplary step sequence of the main processing carried out by the server apparatus MS in the first embodiment of the music piece performance information delivery system of FIG. 1, which will hereinafter be referred to as "server main processing" to distinguish from the main processing carried out in the client apparatus. In this server main processing, various processes are carried out on the basis of requests made via the client apparatus, such as the personal computer terminal PC or portable communication terminal MT, connected via the network X to the server apparatus MS. The server main processing is started up upon turning-on of the server apparatus MS and brought to and end upon turning-off of the server apparatus MS.

At step S41 of the server main processing, a determination is made as to whether or not a new connection request has been received from the client apparatus. With an affirmative (YES) determination at step S41, the user ID and transmission address of the client apparatus are added to the transmission list at step S42. Namely, the CPU 1 of the server apparatus MS determines whether the client apparatus has made an access request to the server apparatus MS, and, if so, the user ID and transmission address included in the request information including the connection request received from the client apparatus are added to the transmission list. At next step S43, a determination is made as to whether or not a new purchase request has been received from the client apparatus. With an affirmative (YES) determination at step S43, the CPU 1 determines an amount to be billed, i.e. a charge, for the music piece performance information which the user of the client apparatus has requested purchase from the server apparatus MS, and adds the to-be-billed amount or charge of the purchase-requested music piece performance information to a billing list corresponding to the user ID, at step S44. Namely, when purchase of any music piece performance information has been requested by the client apparatus, various prices for the requested purchase and use of a music distributing site are added to a corresponding one of billing lists provided in association with users (specifically, in association with user IDs). Thus, the server apparatus MS can collectively bill the user for the use of the music distributing site etc. when the use of the broadcasting site is terminated.

At step S45, a determination is made as to whether or not a new connection end request has been received from the client apparatus. With an affirmative (YES) determination at step S45, the user ID and transmission address are deleted from the transmission list at step S46. Namely, the user ID and transmission address added to the transmission list when the connection request was received from the client apparatus are deleted from the transmission list when a connection end request has been received from the client apparatus. To the client apparatus whose user ID and transmission address have been deleted from the transmission list, no music piece performance information and the like are delivered any longer from the server apparatus MS. At step S47, a charge, corresponding to contents of use, by the user (specified by the user ID), of the music broadcasting site, such as the total number of music pieces delivered, is determined and added to the corresponding billing list. Specific manner of determining such a to-be-billed amount or charge will be described later in more detail. At step S48, the charge recorded in the billing list is billed to the client apparatus. The charge thus billed may be paid by any desired conventionally-known payment method, such as payment into a designated bank account, postal transfer or electronic money.

In the above-described manner, the server apparatus MS carries out various processes in response to various requests from the client apparatus as long as the server apparatus MS is in operation, from powering-on to powering-off of the server apparatus MS.

Figure 9:
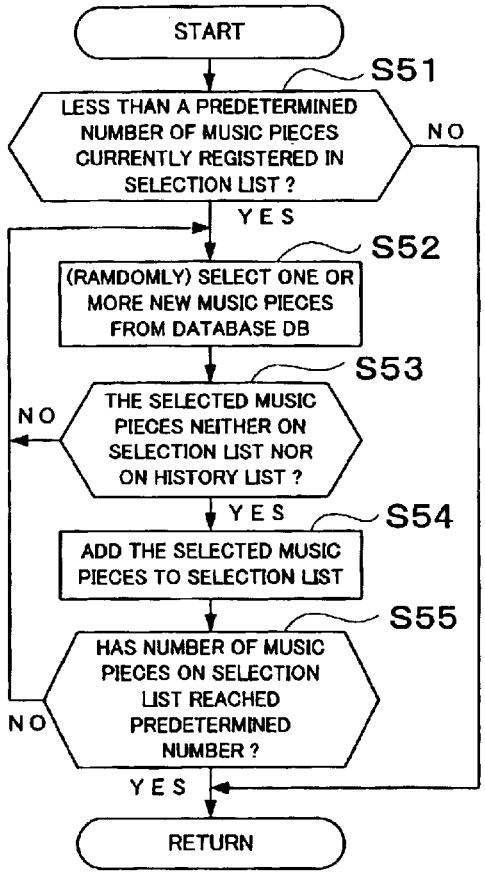
FIG. 9 is a flow chart an example of a music piece selection process carried out by the server apparatus in the first embodiment.

FIG. 9 is a flow chart an example of a music piece selection process carried out by the server apparatus MS, which is an interrupt process activated at predetermined time intervals such that the music piece selection list does not completely run out of music pieces registered thereon. For example, the music piece selection process may be activated each time half the number of music pieces registered on the music piece selection list have been erased from the music piece selection list (i.e., each time half the number of the registered music pieces have been completely reproduced).

At step S51, a determination is made as to whether the number of the music pieces currently registered on the music piece selection list is below a predetermined number. If the number of the currently-registered music pieces is equivalent to or greater than the predetermined number (NO determination at step S51), the music piece selection process is instantly brought to an end without performing any further operation. If, on the other hand, the number of the music pieces currently registered on the music piece selection list is below the predetermined number (YES determination at step S51), then one or more new music pieces are selected randomly from among the music piece performance information database DB, at step S52. At next step S53, it is determined whether the selected one or more music pieces are included in neither the music piece selection list nor the history list. If the selected one or more music pieces are included in neither the music piece selection list nor the history list (YES determination at step S53), they are added to the music piece selection list as the last music pieces, at step S54. In this way, control is performed such that a same music piece is not reproduced frequently within a predetermined time period. In stead of searching for a same music piece from the entire music piece selection list and history list, it may be detected whether a same music piece is included in portions of the music piece selection list and history list which correspond to the predetermined time period or predetermined number of music pieces. If the same music piece is not included in (not found from) the portions of the music piece selection list and history list which correspond to the predetermined time period or predetermined number of music pieces, then the selected music piece is added as a new music piece to the music piece selection list; alternatively, in selecting music pieces at step S52 above, the music pieces stored in the music piece performance information database DB, other than those currently registered on the music piece selection list and history list, may be selected. At step S55, a further determination is made as to whether the number of the music pieces currently registered on the music piece selection list has reached the predetermined number. With a negative (NO) determination at step S55, the CPU 1 reverts to step S52 to repeat the operations of steps S52 to S55; that is, the music piece addition to the music piece selection list is continued. If, on the other hand, the number of the music pieces currently registered on the music piece selection list has reached the predetermined number (YES determination at step S55), then the music piece selection process is brought to an end; thus, the music piece selection beyond the predetermined number can be avoided.

Figure 10:
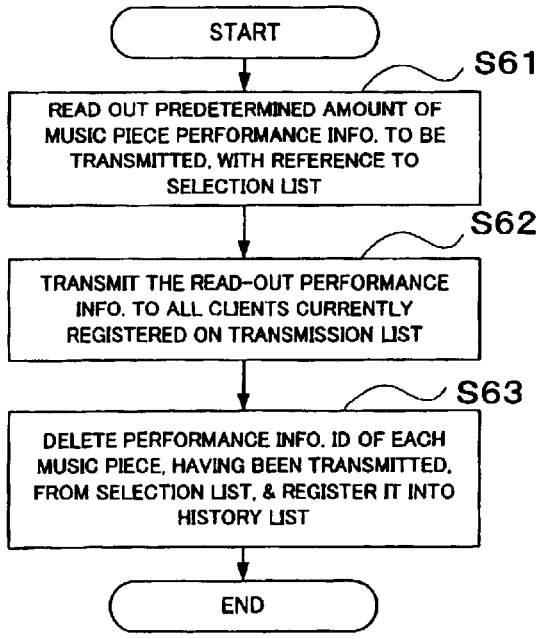
FIG. 10 is a flow chart showing an example of a reproduction process carried out by the server apparatus in the first embodiment.

FIG. 10 is a flow chart showing an example of a reproduction process carried out by the server apparatus MS, which will hereinafter be referred to as a "server reproduction process" to distinguish from the reproduction process carried out in the client apparatus. The server reproduction process is activated interruptively during execution of the server main processing every predetermined time; the predetermined time at which the server reproduction process is activated depends on the manner of the reproduction in the server apparatus MS. In the case of the reproduction based on the streaming delivery, because music piece performance information is delivered from the server apparatus MS in the predetermined data units each having several-minute duration, the server reproduction process is activated at time intervals corresponding to the several-minute duration. In the case of the reproduction based on the downloading delivery, because music piece performance information is delivered from the server apparatus MS in the data units each representative of a single music piece, the server reproduction process is activated every such timing when the downloading can be completed before reproduction of a next music piece is initiated. The server reproduction process is activated interruptively during execution of the server main processing per cycle of the clock pulses generated by the timer 1A of FIG. 2.

At step S61, a predetermined amount of music piece performance information to be transmitted at the current timing is read out, with reference to the music piece selection list. Here, the predetermined amount of music piece performance information comprises the quantity of data corresponding to the data unit of several-minute duration in the case of the streaming delivery, but comprises the quantity of data representative of one or more music pieces in the case of the downloading delivery. The particular music piece performance information to be read out and transmitted is determined in such a manner that it is reproduced in the same order as registered on the music piece selection list. At next step S62, the read-out music piece performance information is transmitted to all client apparatus corresponding to transmission addresses registered on the transmission list; that is, the same music piece performance information is transmitted to all of the users registered on the transmission list. At step S63, the music piece performance information ID of each music piece having been completely transmitted is deleted from the music piece selection list and then registered onto the history list. Registered contents of the history list may be erased little by little in chronological order (i.e., on a "first-transmitted-first-erased" basis) each time the registered information on the history list has reached a predetermined amount.

In the above-described manner, at the same time that the user connects the personal computer terminal PC to the server apparatus MS having stored therein a user-desired music distributing site, the personal computer terminal PC can automatically receive the music piece performance information selected and delivered by the server apparatus MS, so that the personal computer terminal PC can audibly reproduce or sound the music piece based on the received music piece performance information. Then, once the user terminates the connection between the personal computer terminal PC and the server apparatus MS having stored therein the user-desired music distributing site, the currently audibly-reproduced music piece is brought to an end, after which no music piece is sounded any longer unless the personal computer terminal PC is connected to the server apparatus MS having stored therein a user-desired music distributing site. Of course, where desired music piece performance information has already been purchased by the user of the client apparatus, the music piece based on the purchased music piece performance information can be sounded without the personal computer terminal PC being connected to the server apparatus MS having stored therein a user-desired music distributing site.

Figure 11:
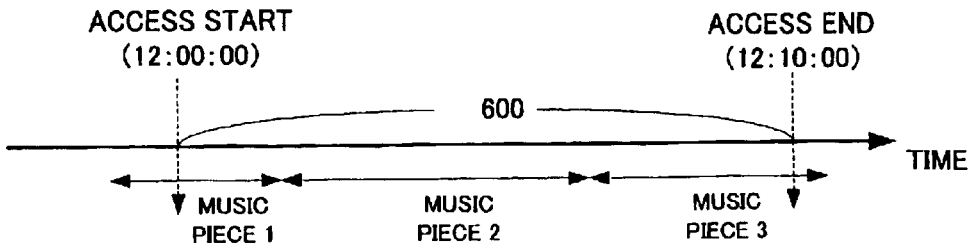
FIG. 11 is a conceptual diagram explanatory of a specific exemplary manner of determining a to-be-billed amount or charge.

Now, a brief description is made about the manner of determining a charge to be added to the billing list (see step S44 of FIG. 8). Each charge amount to be added to the billing list for use of a desired site is determined by "(time length of use)×(unit price per time)" or by "(the number of music pieces used)×(unit price per music piece)". For this purpose, the CPU 1 of the server apparatus MS counts a total time length from a time point when the client apparatus accesses the server apparatus MS having stored therein a user-desired music distributing site to a time point when the client apparatus terminates the access to the server apparatus MS (i.e., time length of use of the site), or counts a total number of music pieces delivered by the server apparatus MS over a time period from the time point when the client apparatus accesses the server apparatus MS having stored therein the user-desired music distributing site to the time point when the client apparatus terminates the access to the server apparatus MS. Then, the CPU 1 determines the charge by multiplying the thus-obtained time length of use or total number of delivered music pieces by the unit price per time or unit price per music piece, and bills the thus-determined charge to the user having used the music distributing site. FIG. 11 is a conceptual diagram explanatory of a specific example of the manner of determining a charge to be billed to the user.

In the illustrated example of FIG. 11, the time point at which the client apparatus starts access to the server apparatus MS is 12:00:00 sharp and the time point at which the client apparatus terminates access to the server apparatus MS is 12:10:00. Therefore, if a charge corresponding to the time length of use is to be calculated assuming that the unit price per second is ¥0.02 (Japanese Yen), the to-be-billed charge can be calculated as ¥12 (i.e., 600 sec.×¥0.02). If, on the other hand, a charge corresponding to the number of music pieces is to be calculated, the number of music pieces has to be counted. The number of music pieces may be counted in any of several ways. In the illustrated example of FIG. 11, the access to the server apparatus MS is initiated at an enroute point of "music piece 1", and the access to the server apparatus MS is terminated at an enroute point of "music piece 3". In such a case, if the music piece counting is performed at the beginning (or end) of each music piece, then "music piece 2" and "music piece 3" (or "music piece 1" and "music piece 2") are counted in so that "two" is obtained as the number of music pieces. If all music piece delivered from the server apparatus MS during duration of the access to the server apparatus MS are counted in irrespective of whether the delivery of any of the music pieces is initiated at an enroute point of the music piece or terminated at an enroute point of the music piece, then all of "music piece 1", "music piece 2" and "music piece 3" are counted in so that "three" is obtained as the number of music pieces. Thus, assuming that the unit price per music piece is ¥5, the to-be-billed charge can be calculated as ¥10 (two music pieces×¥5) or ¥15 (three music pieces×¥5).

It should be appreciated that the to-be-billed amount or charge may be determined by the server apparatus MS in any other manner than the above-described. For example, if the use, by the client apparatus, of the server apparatus MS falls within a predetermined time or predetermined number of music pieces, a predetermined fixed minimum or basic amount may be set as the charge, while if the use, by the client apparatus, of the server apparatus MS falls outside a predetermined time or predetermined number of music pieces, the to-be-billed charge may be set by adding, to the predetermined fixed minimum charge, an amount corresponding to the actual time length of use or actual number of music pieces beyond the predetermined time or predetermined number. As an example, ¥15 may be billed for use of not more than five music pieces, and if six or more music pieces have been used, ¥5 may be added for each extra music piece beyond five.

The first embodiment has been described as recording, in the music piece selection list, the ID of each music piece performance information to be transmitted and selecting desired music piece performance information from the music piece performance information DB in accordance with the music piece selection list, so as to deliver the selected music piece performance information from the server apparatus to the client apparatus. In a modification of the first embodiment, music piece performance information to be delivered may be selected from the music piece performance information DB each time new music piece performance information is to be transmitted.

According to the above-described first embodiment, the client apparatus, such as the personal computer terminal, is allowed to automatically sound a desired music piece by just being connected to the server apparatus. Thus, the client apparatus can reproduce a plurality of different music pieces in succession, without a break, for a desired time through simple user operation, i.e. without the user having to perform bothersome operation. Further, because it is only necessary for each user to connect the client apparatus to the server apparatus, the above-described first embodiment allow many users to enjoy same music pieces at the same time.

Next, a description will be made about a second embodiment of the present invention, with reference to FIGS. 12 to 19. Hardware of the server apparatus MS and client apparatus in the second embodiment may be constructed in the manner of FIGS. 1 and 2 similarly to the first embodiment. Note, however, that the server apparatus MS in the second embodiment is constructed to transmit either music piece performance information selected in response to a request from the client apparatus or music piece performance information automatically selected by the server apparatus MS. Also, the client apparatus can cause music piece performance information of a user-desired music piece (request music piece) to be incorporated in music piece performance information that is to be transmitted by the server apparatus MS, by transmitting a request for the music piece to the server apparatus MS having stored therein an accessed music distributing site. Namely, by accessing a predetermined music distributing site (server apparatus MS), the user can request a desired music piece from the music distributing site, and then the client apparatus can automatically receive music piece performance information including the requested music piece from the music distributing site so that the desired music piece can be sounded or played on the client apparatus.

Figure 12:
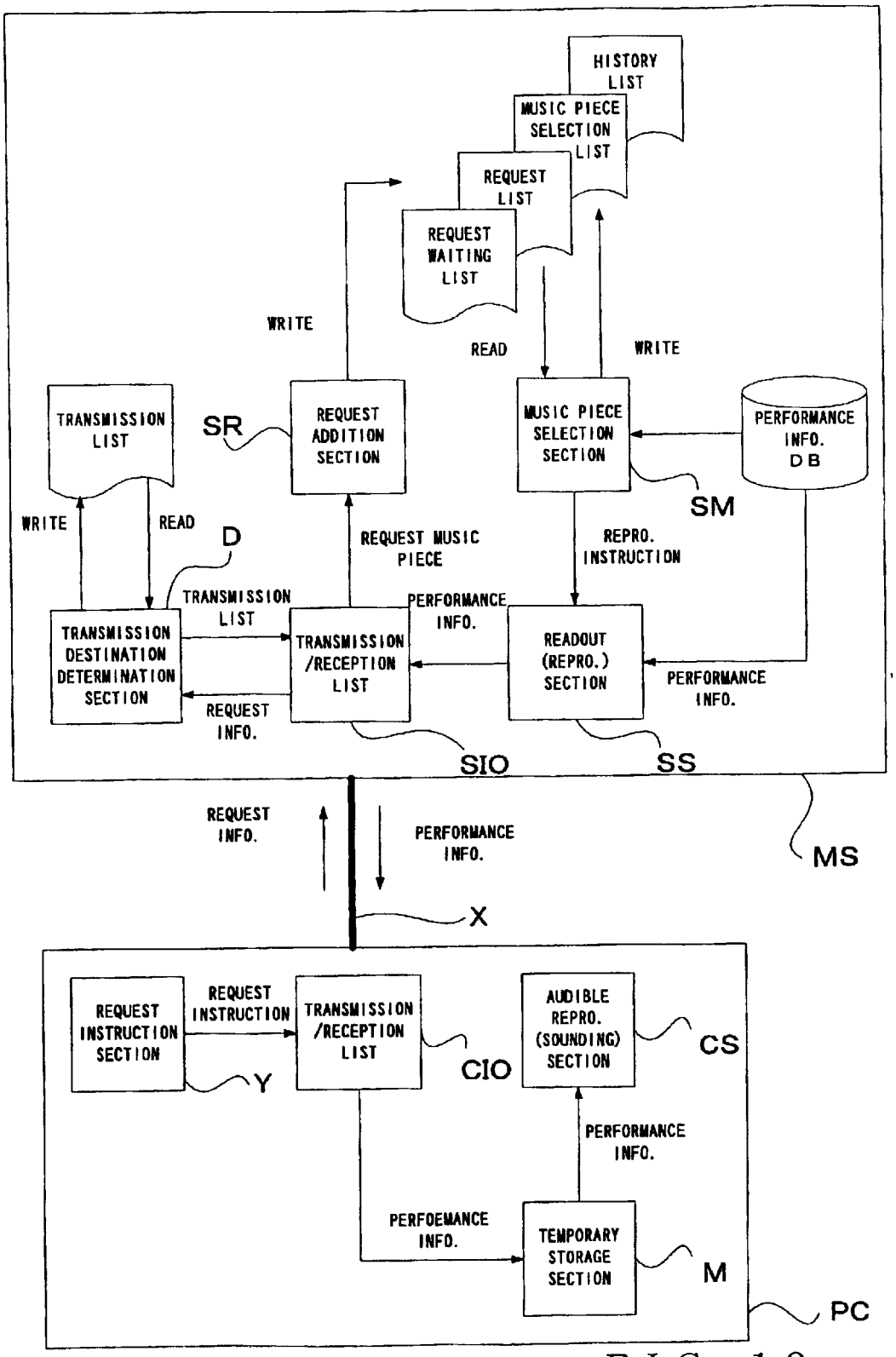
FIG. 12 is a functional block diagram explanatory of various functions performed by a personal computer terminal (client apparatus) and server apparatus in a second embodiment of the music piece performance information delivery system.

FIG. 12 is a functional block diagram explanatory of various functions performed by the personal computer terminal PC (client apparatus) and server apparatus MS in the second embodiment of the music piece performance information delivery system. Functional blocks in FIG. 12 which are imparted with the same reference characters as in FIG. 3 represent the already-described functions of FIG. 3, and hence will not be described to avoid unnecessary duplication. In the illustrated example of FIG. 12, the request instruction section Y can give the server apparatus MS a music piece delivery request, in addition to a connection request and connection end request similar to those shown in FIG. 3. The music piece delivery request is intended to request the server apparatus MS to deliver a user-desired music piece. Further, the server apparatus MS has, in addition to the functions having been described above in relation to the first embodiment, a function of a request addition section SR, request list function and request waiting list function. In accordance with request information received from the personal computer terminal PC via the transmission/reception section SIO of the server apparatus MS, the request addition section SR writes or deletes a requested music piece (the terms will hereinafter be used interchangeable with the terms "request music piece") to or from a request list or request waiting list. The request list is intended to record therein each music piece, requested by any of the personal computer terminals PC, along with an expected (scheduled) performance time of the request music piece in the order the request of the music piece has been accepted by the server apparatus MS. The server apparatus MS reads out music piece performance information of each requested music piece thus recorded in the request list, with priority over music piece performance information of other music pieces currently recorded in the music piece selection list, and transmits the thus read-out music piece performance information to the personal computer terminal PC. The priority given to the requested music piece need not necessarily the top priority and may be the second or third priority as counted from a currently-delivered music piece. Namely, each requested music piece can be delivered in an interleaved state where it is interleaved or incorporated between the music pieces automatically-registered on the music piece selection list. The request waiting list is provided for temporarily waiting acceptance of a requested music piece till a lapse of a predetermined waiting state expiration time, so as to prevent the same music piece from being frequently delivered in a repeated fashion within a predetermined time period. Because, if a music piece requested from the personal computer terminal PC is one having been just delivered (or one expected or scheduled to be delivered) within a predetermined time period after (i.e., at less than a predetermined time interval from) the last delivery of the same music piece, and if such a requested music piece is registered on the request list, then the same music piece would be undesirably delivered in repeatedly. To avoid such an inconvenience, this embodiment is designed to temporarily register a newly-requested music piece onto the request waiting list, rather than directly into the request list, so that the requested music piece is waited properly so as not to be delivered within the predetermined time period. Thus, in the request waiting list, each of music pieces requested via the personal computer terminal PC, which has not been registered on the request list (i.e. which has already been delivered or is scheduled to be delivered within the predetermined time period), is recorded into the request list on a so-called "first-come, first-served basis".

Figure 13:
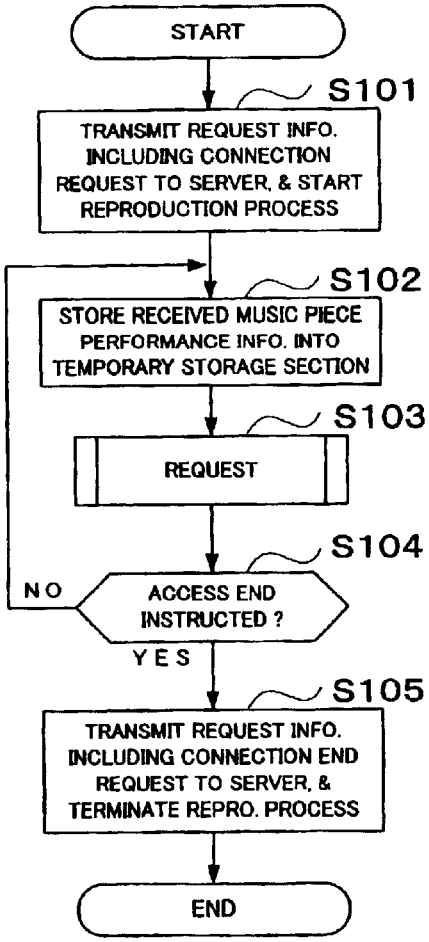
FIG. 13 is a flow chart showing an example of main processing carried out by the client apparatus in the second embodiment.

This and following paragraphs describe an example of main processing carried out by the client apparatus in the second embodiment, with reference to FIG. 13. At step S101, the client apparatus transmits request information including a connection request to the server apparatus MS having stored therein a user-desired music distributing site, and also starts up a reproduction process (client reproduction process). Namely, the client apparatus requests access to the user-desired music distributing site and activates the reproduction process for audibly reproducing a music piece on the basis of music piece performance information received from the server apparatus MS. Details of the client reproduction process may be similar to those having been described above in relation to FIG. 7. At step S102 of the client reproduction process, music piece performance information received from the server apparatus MS is stored in the temporary storage area. Namely, although not specifically illustrated in the client main processing of FIG. 13, the client main processing includes a confirmation operation for periodically checking presence/absence of reception of music piece performance information sequentially delivered from the server apparatus MS, and only when this checking operation has confirmed that music piece performance information has been received from the server apparatus MS, the thus-received music piece performance information is stored in the temporary storage area. Each music piece performance information received from the server apparatus MS comprises data units each having several-minute duration in the case of the streaming delivery, but comprises data units each representative of a single music piece in the case of the downloading delivery. The client apparatus temporarily stores, in the temporary storage area of the RAM 3 or the like, the music piece performance information having been received in such data units.

At next step S103, a request process is carried out for requesting the server apparatus MS to deliver a user-desired music piece, as will be later described in detail. At step S104, a determination is made as to whether or not any instruction for terminating the access to the server apparatus MS has been given by the user. With a negative (NO) determination at step S104, the client apparatus reverts to step S102 above to repeat the operations of steps S102 to S104. Namely, because reception, from the music distributing site, of music piece performance information of a plurality of music pieces is performed repeatedly as long as the client apparatus is connected to the music distributing site (server apparatus MS), the client apparatus can generate audible tones of the different music pieces in succession, without a break, by reproducing the received music piece performance information. If, on the other hand, the instruction for terminating the access to the server apparatus MS has been given by the user (YES determination at step S104), the client apparatus transmits request information including a connection end request to the server apparatus MS and terminates or deactivates the client reproduction process, at step S105.

Figure 14:
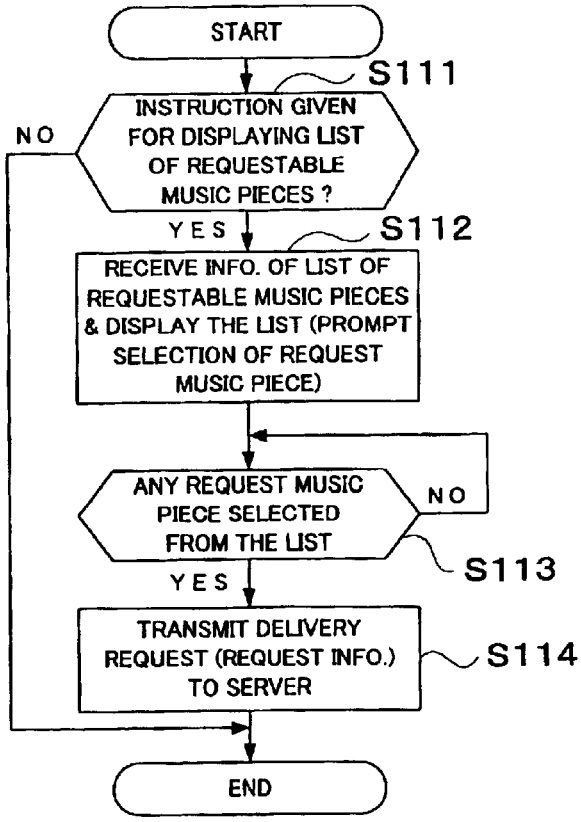
FIG. 14 is a flow chart showing an example of a request process shown in FIG. 13.

Now, the request process carried out at step S103 in the client main processing of FIG. 13 is described with reference to a flow chart of FIG. 14. At step S111, a determination is made as to whether or not any instruction for displaying a list of requestable music pieces has been given by the user. With a NO determination at step S111, the client apparatus brings the request process to an end instantly without performing any further operation. If, on the other hand, such an instruction for displaying a list of requestable music pieces has been given by the user (YES determination at step S111), the client apparatus receives list information, representative of the list of requestable music pieces, from the server apparatus MS and displays the received list on the display device at step S112. Specifically, once the user of the client apparatus activates, for example, a list display switch provided on the client apparatus, request information requesting list information, representative of the list of requestable music pieces, is transmitted from the client apparatus to the server apparatus MS. In response to such request information from the client apparatus, the server apparatus MS transmits the requested list information to the client apparatus. Then, the client apparatus receives the list information and uses the received list information to display, on its display device 6A, the list of requestable music pieces which the user of the client apparatus can request from the music distributing site (i.e., listing of items of music piece performance information stored in the server apparatus MS). At step S113, it is determined whether or not any request music piece has been selected by the user from the thus-displayed list of requestable music pieces. If any request music piece has been selected by the user as determined at step S113, the client apparatus transmits request information including a music piece delivery request to the server apparatus MS, at step S114. In this case, the request information transmitted to the server apparatus MS includes, in addition to data indicative of the music piece delivery request, data indicative of the user ID and request music piece.

Thus, where the user of the client apparatus does not know what music pieces (what items of music piece performance information) can be requested of the music distributing site (server apparatus MS) to which the client apparatus is being connected, the above-described arrangements allow the client apparatus to display the list of music pieces requestable of the music distributing site in response user's activation of the predetermined list display switch, so that the user can readily decide a desired request music piece on the basis of the displayed list of requestable music pieces. Namely, the client apparatus can prompt the user to select a request music piece by displaying the list of requestable music pieces.

Whereas the request process has been described above as displaying only a list of requestable music pieces, it may be arranged to cause the client apparatus to display, simultaneously with the list of requestable music pieces, a listing of music pieces for which requests have already been accepted by the server apparatus MS (i.e., request-accepted music pieces having already been registered on the request list of the server apparatus MS) and or a listing of music pieces kept waiting for acceptance of the request (i.e., music pieces registered on the request waiting list). In this way, the user of the client apparatus can readily know whether his or her requested music piece has already been accepted by the server apparatus MS through another user's request or is waiting for acceptance by the server apparatus MS, as a result of which any wasteful request can be effectively avoided.

Figure 15:
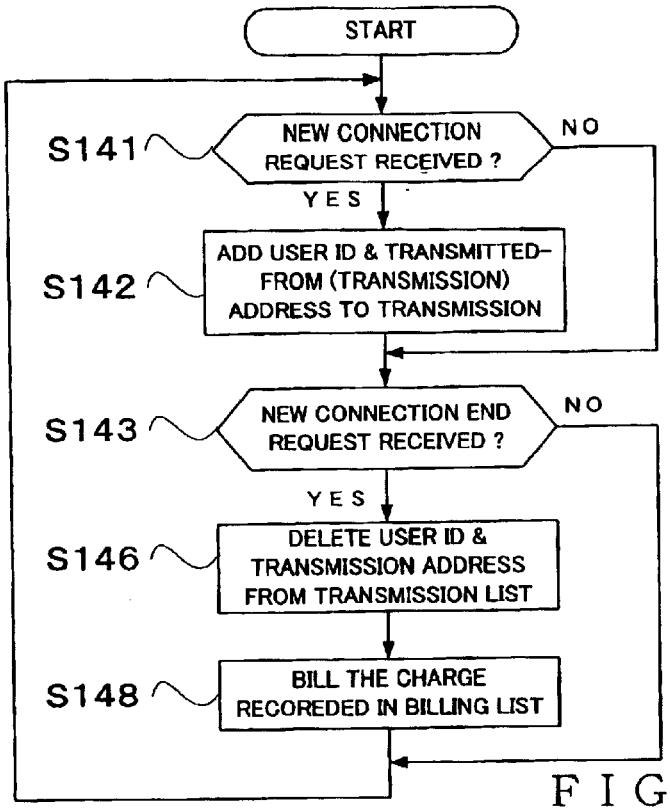
FIG. 15 is a flow chart showing an exemplary step sequence of main processing carried out by the server apparatus in the second embodiment.

In the second embodiment, the server apparatus MS carries out various processes as set forth below. FIG. 15 is a flow chart showing an exemplary step sequence of main processing carried out by the server apparatus MS in the second embodiment, which will hereinafter be referred to as "server main processing" to distinguish from the main processing carried out in the client apparatus. In this server main processing, various processes are carried out on the basis of requests made by the client apparatus, such as the personal computer terminal PC or portable communication terminal MT, connected via the network X to the server apparatus MS, as in the first embodiment. Operations of steps S141, S142, S143, S146 and S148 in FIG. 15 are similar to the above-described operations of steps S41, S42, S43, S46 and S48 in FIG. 8 and hence will not be described here to avoid unnecessary duplication.

Figure 16:
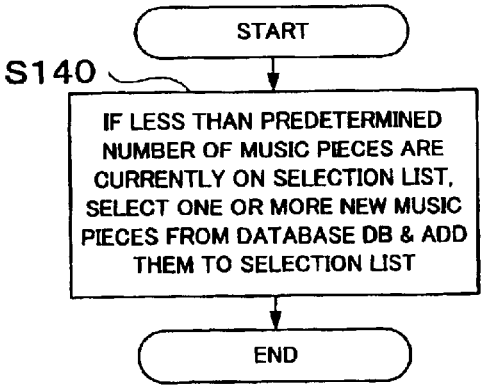
FIG. 16 is a flow chart showing an example of a music piece selection list editing process carried out by the server apparatus in the second embodiment.

FIG. 16 is a flow chart showing an example of a music piece selection list editing process that is carried out by the server apparatus MS in the second embodiment. The music piece selection list editing process is an interrupt process activated at predetermined time intervals such that the music piece selection list does not completely run out of registered music pieces. For example, the music piece selection list editing process may be activated each time half the number of music pieces registered on the music piece selection list has been erased from the music piece selection list (i.e., each time half the number of the registered music pieces has been completely reproduced).

If the number of music pieces currently registered on the music piece selection list is less than a predetermined number, one or more new music pieces are selected from the music piece performance information database DB and added to the music piece selection list as the last music pieces, at step S140. At this time, the server apparatus MS performs music piece addition to the music piece selection list while performing control the music piece selection so that two or more same music pieces are not included in the music piece selection list. If, on the other hand, the number of music pieces currently registered on the music piece selection list is equivalent to or greater than the predetermined number, the new music piece selection is not executed. Namely, the music piece addition to the music piece selection list will not be performed beyond the predetermined number. The thus automatically-prepared music piece selection list will be used to select music pieces therefrom when no user-requested music piece is registered on the request list, e.g. when all user-requested music pieces have been completely delivered to the client apparatus or when there is no user-requested music piece at all. Namely, items of music piece performance information automatically selected in accordance with the prepared music piece selection list are delivered to every client apparatus currently connected to the server apparatus in such a manner that no break occurs in audible reproduction of music pieces by the client apparatus even when no user-requested music piece is registered on the request list, as will be later described in a server reproduction process of FIG. 19.

Figure 17:
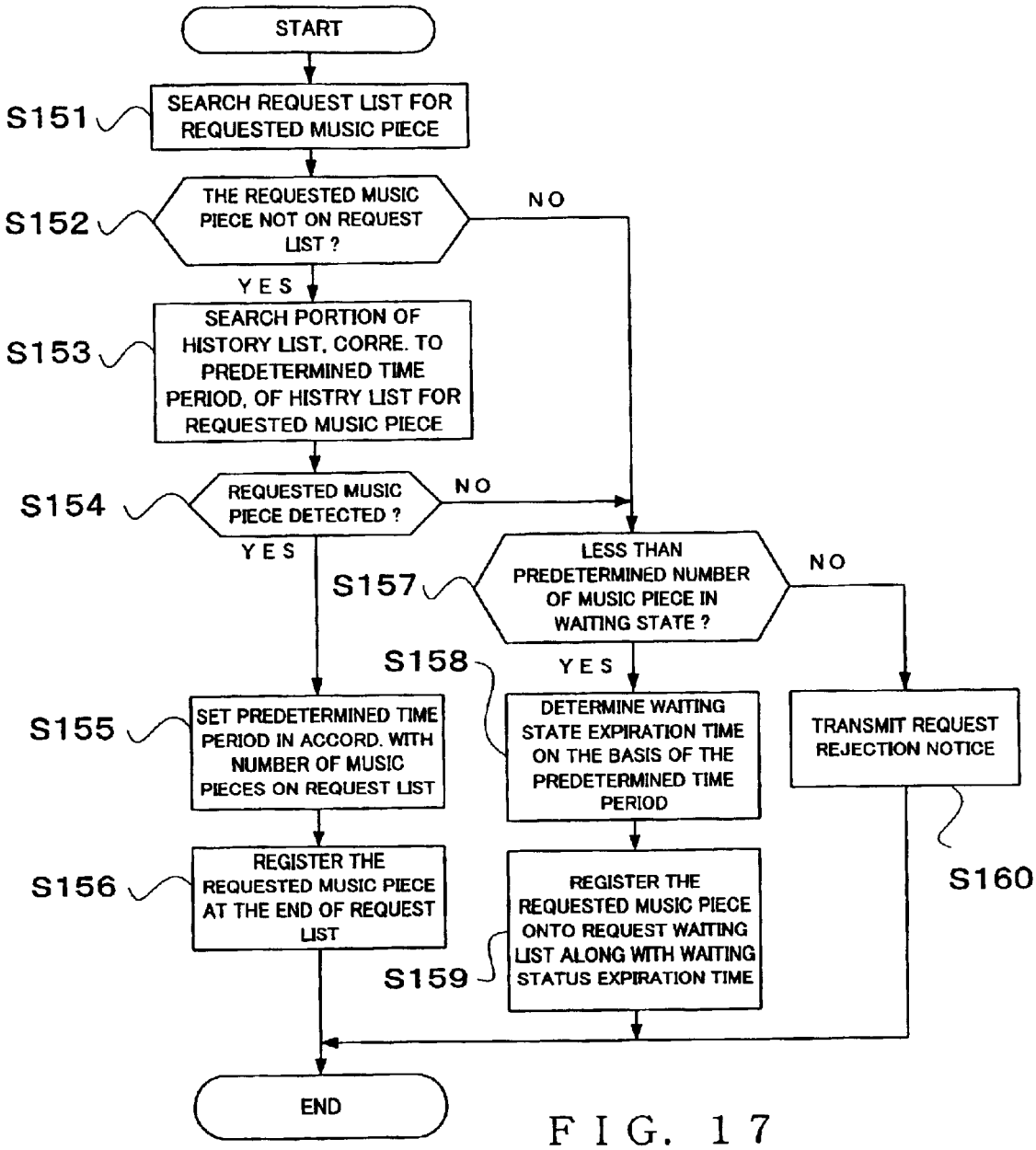
FIG. 17 is a flow chart showing an example of a request list editing process carried out by the server apparatus in the second embodiment.

FIG. 17 is a flow chart showing an example of a request list editing process carried out by the server apparatus MS in the second embodiment, which is intended to register, on the request list, a user-desired music piece as a requested music piece on the basis of a request made by the user of the client apparatus. Namely, this request list editing process is an interrupt process triggered each time request information including a music piece delivery request is received from the client apparatus.

At step S151, the request list is searched for any requested music piece. It is then determined at step S152 whether or not the user requested music piece has been detected from the request list. Namely, the operations of steps S151 and S152 are directed to checking to see whether or not the requested music piece has already been registered on the request list as an "already-"request-accepted music piece". If the requested music piece has not been detected from the request list, i.e. if the user-requested music piece has not yet been registered on the request list (YES determination S152), the user-requested music piece is searched for through a portion of the history list corresponding to a predetermined time period, and a determination is made as to whether the user-requested music piece has been detected from the history list (steps S153 and S154). Namely, at steps S153 and S154, it is checked whether or not the user-requested music piece has already been registered on the history list as having already been delivered to the client apparatus within the predetermined time period preceding the current time point. The predetermined time period represents a minimum necessary time interval, e.g. thirty minutes or one hour, between successive reproductions of a same music piece. This predetermined time period is variably set in accordance with the number of music pieces registered on the request list, as will be later described in detail. If the user-requested music piece has not been detected within the portion, corresponding to the predetermined time period, of the history list, namely, if the last delivery of the user-requested music piece is not within the predetermined time period (YES determination at step S154), the predetermined time period is varied in accordance with the number of music pieces currently registered on the request list at step S155, and then the user-requested music piece is registered at the end of the request list at step S156.

If, on the other hand, the user-requested music piece has been detected from at least one of the request list and history list, i.e. if the user-requested music piece is already a request-accepted music piece or has already been delivered to the client apparatus (NO determination at step S152 or S154), a further determination is made at step S157 as to whether the number of music pieces currently registered on the request waiting list is below a predetermined number. If the number of music pieces currently registered on the request waiting list is below the predetermined number (YES determination at step S157), the waiting state expiration time is determined, at step S158, on the basis of the predetermined time period having been set at step S155 above. Then, the thus-determined waiting state expiration time is imparted to the user-requested music piece so that the user-requested music piece with the waiting state expiration time is registered on the request waiting list, at step S159. Namely, in the case where the user-requested music piece is already a request-accepted music piece or has already been delivered to the client apparatus within the predetermined time period, the music piece requested by the user is temporarily registered onto the request waiting list so as to accept the request with an appropriate time interval from the last delivery of the same music piece. The waiting state expiration time is determined by calculating a predetermined time point after reproduction of the user-requested music piece is to be executed (or after the last reproduction of the user-requested music piece. Namely, in the case where the user-requested music piece has been detected from the request list, the waiting state expiration time is set to a predetermined time after an expected performance time of the user-requested music piece, while in the case where the user-requested music piece has been detected from the history list, the waiting state expiration time is set to a predetermined time after the last performance start time of the user-requested music piece. For example, if the expected performance time or last performance start time of the user-requested music piece is 12:00:05 (12 hr., 0 min. and 5 sec.) and the predetermined time is set to 35 min. and 15 sec., then the waiting state expiration time will be set to 12:35:20 (12 hr., 35 min. and 20 sec.). If the number of music pieces currently registered on the request waiting list is not below the predetermined number (NO determination at step S157), the server apparatus MS transmits request rejection notice to the client apparatus, at step S160; namely, in this case, no request from the user is accepted by the server apparatus MS.

Figure 18:
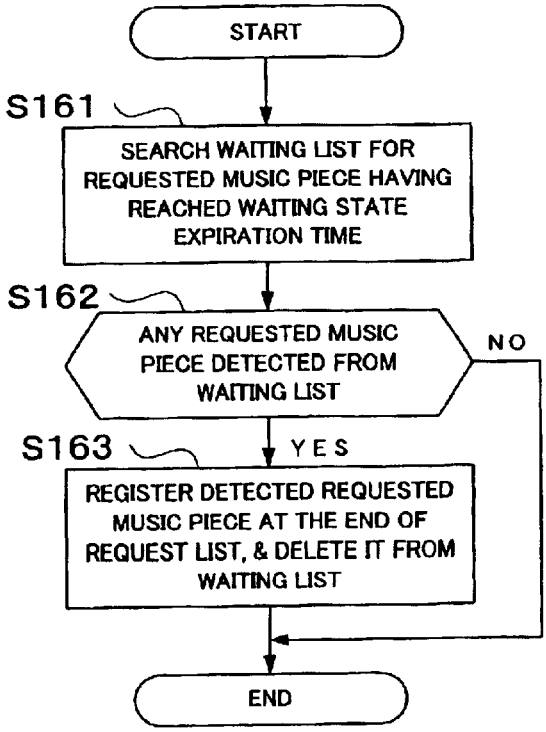
FIG. 18 is a flow chart showing an example of a request-waiting-list editing process carried out by the server apparatus in the second embodiment.

This and following paragraphs describe an example of a request-waiting-list editing process carried out by the server apparatus MS in the second embodiment, with reference to a flow chart of FIG. 18. This request-waiting-list editing process is an interrupt process activated every predetermined time. At step S161, a search is made through the request waiting list for any user-requested music piece which has reached the request waiting state expiration time. If such a user-requested music piece has been detected from the request list (YES determination at step S162), the detected user-requested music piece is deleted from the request waiting list and added at the end of the request list, at step S163. Namely, the server apparatus MS accepts the request for the user-desired music piece which has so far been kept waiting for acceptance by the server apparatus MS, and then make necessary arrangements to deliver the user-requested music piece to the client apparatus.

Thus, only in the case where a music piece newly requested by the user of the client apparatus is neither one for which user request has already been accepted by the server apparatus nor one which has already been delivered to the client apparatus within the predetermined time period preceding the current time point, the requested music piece is accepted as a new request music piece. If, on the other hand, the music piece newly requested by the user of the client apparatus is one for which user request has already been accepted by the server apparatus or one which has been delivered to the client apparatus within the predetermined time preceding the current time point, acceptance of the newly-requested music piece is waited without the newly-requested music piece being accepted instantly by the server apparatus MS, and then, after a lapse of the predetermined time, the server apparatus MS cancels the waiting state of the newly-requested music piece to accept the request. Namely, control is performed to register the newly-requested music piece onto the request list at the predetermined time interval from the last delivery of the same music piece, so as to avoid the same music piece from being frequently reproduced in a repeated fashion. For example, if an expected performance time of the user-requested music piece is 12:00:05 (12 hr., 0 min. and 5 sec.) and the predetermined time interval is set to 35 min. and 15 sec., then the waiting state expiration time will be set to 12:35:20 (12 hr., 35 min. and 20 sec.) in the instant embodiment, as previously noted. In such a case, once the current time has passed 12:35:20 (12 hr., 35 min. and 20 sec.), the registration of the requested music piece is shifted from the request waiting list over to the request list. However, in the event that a great many requested music pieces have already been registered on the request waiting list, and if any further user-requested music piece is to be registered onto such a request waiting list, it will take a very long time for the further user-requested music piece to be accepted and then delivered by the server apparatus to the client apparatus. Namely, because a great amount of time would be undesirably required before the user can ultimately listen to a reproduction of the requested music piece, the server apparatus in the instant embodiment rejects the user's request when more than a predetermined number of music pieces are registered on the request waiting list, and it rejects acceptance of any further request for music piece.

Now, a more detailed description is made about the manner in which the predetermined time period is variably set. In case every new user-requested music piece is accepted by the server apparatus MS without limitations, the same music piece, if requested many times, would play frequently in a repeated fashion, which would undesirably lead to the problem that the music distributing site in question tends to be used exclusively by a specific user. This is why, if a same music piece has been requested a plurality of times within a relatively short period of time, the instant embodiment performs control to accept the request of the music piece at a predetermined time interval from the last delivery or reproduction of the same music piece. According to the request acceptance control based on the predetermined time interval in the instant embodiment, the predetermined time interval is varied depending on the number of requested music pieces currently accepted by the server apparatus MS and the number of requested music pieces currently kept waiting for acceptance by the server apparatus MS, so that, in the instant embodiment, the time from the start of the acceptance waiting state to the acceptance of the request can be increased or decreased in accordance with the number of requested music pieces currently accepted by the server apparatus MS and the number of requested music pieces currently kept waiting for acceptance. For example, when the number of music pieces currently registered on the request list, namely, the number of music pieces having already been selected but remaining to be delivered, is below a predetermined number, the predetermined time interval is set to be shorter than a predetermined standard time and thereby the waiting state expiration time determined on the basis of the predetermined time interval is set to be closer to the current time, so that the requested music piece can be accepted by the server apparatus MS as soon as possible. Conversely, when the number of music pieces currently registered on the request list is greater than the predetermined number, the predetermined time interval is set to be longer than the predetermined standard time and thereby the waiting state expiration time determined on the basis of the predetermined time interval is set to be farther from the current time, so that the requested music piece can be accepted by the server apparatus MS as late as possible.

Whereas the second embodiment has been described above as varying the predetermined time interval only in accordance with the number of music pieces currently registered on the request list, the predetermined time interval may be varied, taking into account the number of music pieces currently registered on the request waiting list. Further, in the case where a same music piece has been requested a plurality of times, the embodiment is arranged to perform the request acceptance control in accordance with the predetermined time interval as described above; in an alternative, the request acceptance control may be performed in accordance with the number of music pieces currently registered on the request list. Namely, even where a newly-requested music piece is among the music pieces having already been registered on the request list, the newly-requested music piece is registered onto the request list if more than a predetermined number of other request music pieces are currently registered on the request list after the already-registered music piece identical to the newly-requested music piece. However, if not more than the predetermined number of other request music pieces are currently registered on the request list after the already-registered music piece identical to the newly-requested music piece, the newly-requested music piece is temporarily registered onto the request waiting list so that it will be rewritten from the request waiting list to the request list at the time point when more than the predetermined number of other request music pieces have been registered on the request list after the already-registered music piece identical to the newly-requested music piece; namely, once more than the predetermined number of other request music pieces have been registered on the request list after the already-registered music piece identical to the newly-requested music piece, the newly-requested music piece is released from the waiting state so as to be accepted by the server apparatus MS.

Figure 19:
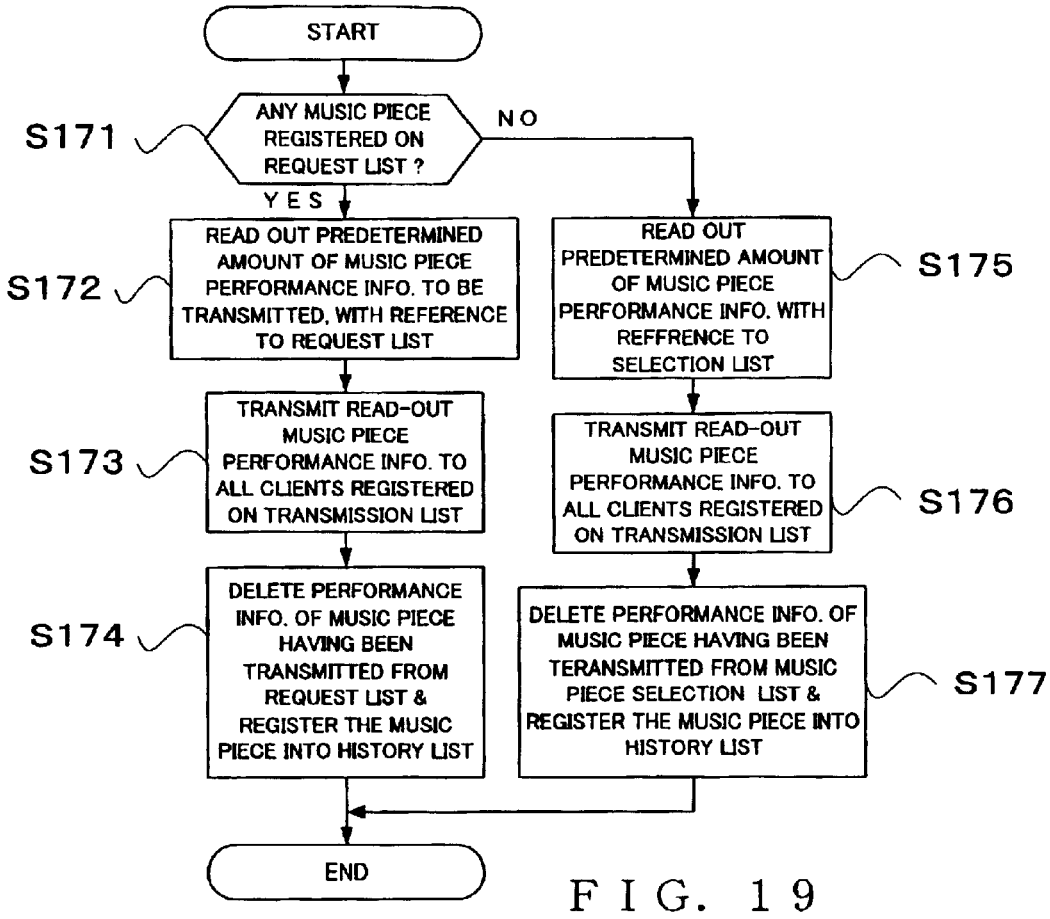
FIG. 19 is a flow chart showing an example of a reproduction process carried out by the server apparatus in the second embodiment.

FIG. 19 is a flow chart showing an example of a reproduction process carried out by the server apparatus MS, which will hereinafter be referred to as a "server reproduction process" to distinguish from the reproduction process carried out in the client apparatus. In this server reproduction process, music pieces registered on the request list are reproduced with priority over other music pieces registered on the music piece selection list. Namely, the music pieces registered on the request list are reproduced in the order they were registered, i.e. in the order the requests for the music pieces were accepted, and only when no music piece is registered on the request list, the music pieces registered on the music piece selection list are reproduced in the order they were selected. The server reproduction process in the second embodiment is activated interruptively during execution of the above-described server main processing, as in the first embodiment.

At step S171, a determination is made as to whether any music piece is currently registered on the request list. If answered in the affirmative at step S171, a predetermined amount of music piece performance information to be transmitted is read out with reference to the request list, at step S172. Here, the predetermined amount of the music piece performance information to be transmitted comprises the quantity of data corresponding to a data unit having several-minute duration in the case of the streaming delivery, but comprises the quantity of data representative of one or more music pieces in the case of the downloading delivery. The thus read-out music piece performance information is transmitted to all client apparatus currently registered on the transmission list, at step S173; namely, the same music piece performance information is transmitted simultaneously to all the client apparatus currently registered on the transmission list. Each time the transmission of the music piece performance information of one music piece is completed, the music piece performance information of the music piece is erased from the request list and registered onto the history list, at step S174. Namely, if any music piece is currently registered on the request list as determined at step S171, the music piece performance information is read out on the basis of the music piece currently registered on the request list and delivered to all the client apparatus currently registered on the transmission list; namely, the music piece performance information of the user-requested music piece is transmitted, with priority over other music piece performance information, simultaneously to all the client apparatus currently connected to the server apparatus MS via the communication network.

If, on the other hand, no music piece is currently registered on the request list (NO determination at step S171), a predetermined amount of music piece performance information to be transmitted is read out with reference to the music piece selection list, at step S175. The thus read-out music piece performance information is delivered, at step S176, to all the client apparatus currently registered on the transmission list. Each time the transmission of the music piece performance information of one music piece is completed, the music piece is erased from the music piece selection list and registered onto the history list, at step S177. Namely, if no music piece is currently registered on the request list as determined at step S171, the music piece performance information is read out and delivered on the basis of the music piece currently registered on the music piece selection list. In other words, in cases where there is no request for music piece from the user, such as where all user-requested music pieces have already been delivered to the client apparatus, music piece performance information automatically selected via the server apparatus MS is transmitted simultaneously to all the client apparatus currently connected to the server apparatus MS via the communication network.

With the above-described arrangements, once the user of any one of the client apparatus is connected to the server apparatus MS via the communication network, the client apparatus can automatically receive music piece performance information, delivered successively from the server apparatus MS, and thereby audibly reproduce or sound the music pieces based on the received music piece performance information. At that time, the server apparatus MS selects, with higher priority, music piece performance information of each user-requested music piece having been accepted thereby and then delivers the selected music piece performance information to the client apparatus. Only when there is no user-requested music piece accepted by the server apparatus MS, the music piece performance information automatically selected via the server apparatus MS is delivered to the client apparatus. Namely, when a user-requested music piece has been accepted by the server apparatus MS, the user-requested music piece is delivered to the client apparatus with priority over the music pieces automatically selected by the server apparatus MS. Once the user terminates the connection between his or her client apparatus and the server apparatus MS having stored therein a desired music distributing site, the music piece being currently sounded on the client apparatus is silenced, after which no audible music reproduction is automatically carried out unless the client apparatus is again connected to the server apparatus MS having stored therein a desired music distributing site.

Although the server reproduction process of FIG. 19 is arranged to immediately make reference to the music piece selection list when the request list has run out of registered music pieces (see step S175 of FIG. 19), the present invention is not so limited. For example, as the most preferable form of behavior when the request list has run out of registered music pieces, a determination may be made whether any registered music piece is currently on the request waiting list. If any registered music piece is currently on the request waiting list, the music piece performance information of the registered music piece is transmitted to and audibly reproduced by the client apparatus, but, if not, music piece performance information may be selectively read out with reference to the music selection list and transmitted to and audibly reproduced by the client apparatus. This alternative arrangement is useful in that it can appropriately deal with a user's request, although it may cause the same music to be undesirably reproduced frequently in a repeated fashion. Further, the server reproduction process has been described as registering, on the request list, music pieces requested by individual users, selecting music piece performance information from the music piece performance information DB with reference to the request list and delivering the thus-selected music piece performance information to the client apparatus. In an alternative, the server reproduction process may be arranged to register individual user-requested music pieces directly on the music piece selection list without the request list provided. In such a case, each of the user-requested music pieces is recorded into the music piece selection list at a position to be referred next, i.e. immediately after the currently-delivered music piece, (e.g., at the beginning of the music piece selection list). In these cases too, it is preferable that the request waiting list be provided as in the above-described examples. Thus, it just suffices to refer to the music piece selection list in order to select a music piece to be audibly reproduced, as a result of which the server reproduction process can be simplified to a significant degree. In another alternative, both the request list and the music piece selection list may be dispensed with; in this case, when any user has requested a music piece, the music piece performance information of the requested music piece may be read out from the music piece performance information database DB, while when there is no user-requested music piece, music piece performance information may be selectively read out from the database DB at each predetermined timing for delivering new music piece performance information to the client apparatus.

According to the above-described second embodiment, each client apparatus, such as the personal computer terminal, can request a user-desired music piece from the server apparatus, and, if the request is acceptable, the server apparatus MS delivers the requested music piece to the client apparatus with priority over other music pieces. Thus, when the user wants to enjoy successive reproduction of music pieces by connecting his or her client apparatus, such as a personal computer terminal, to a desired server apparatus, the second embodiment advantageously allows any user-desired music piece to be readily reproduced by the user requesting the music piece.

Next, a description will be made about a third embodiment of the present invention, with reference to FIGS. 20 to 26. The hardware of the server apparatus MS and client apparatus in the third embodiment may be constructed in the manner of FIGS. 1 and 2 similarly to the first embodiment.

Figure 20:
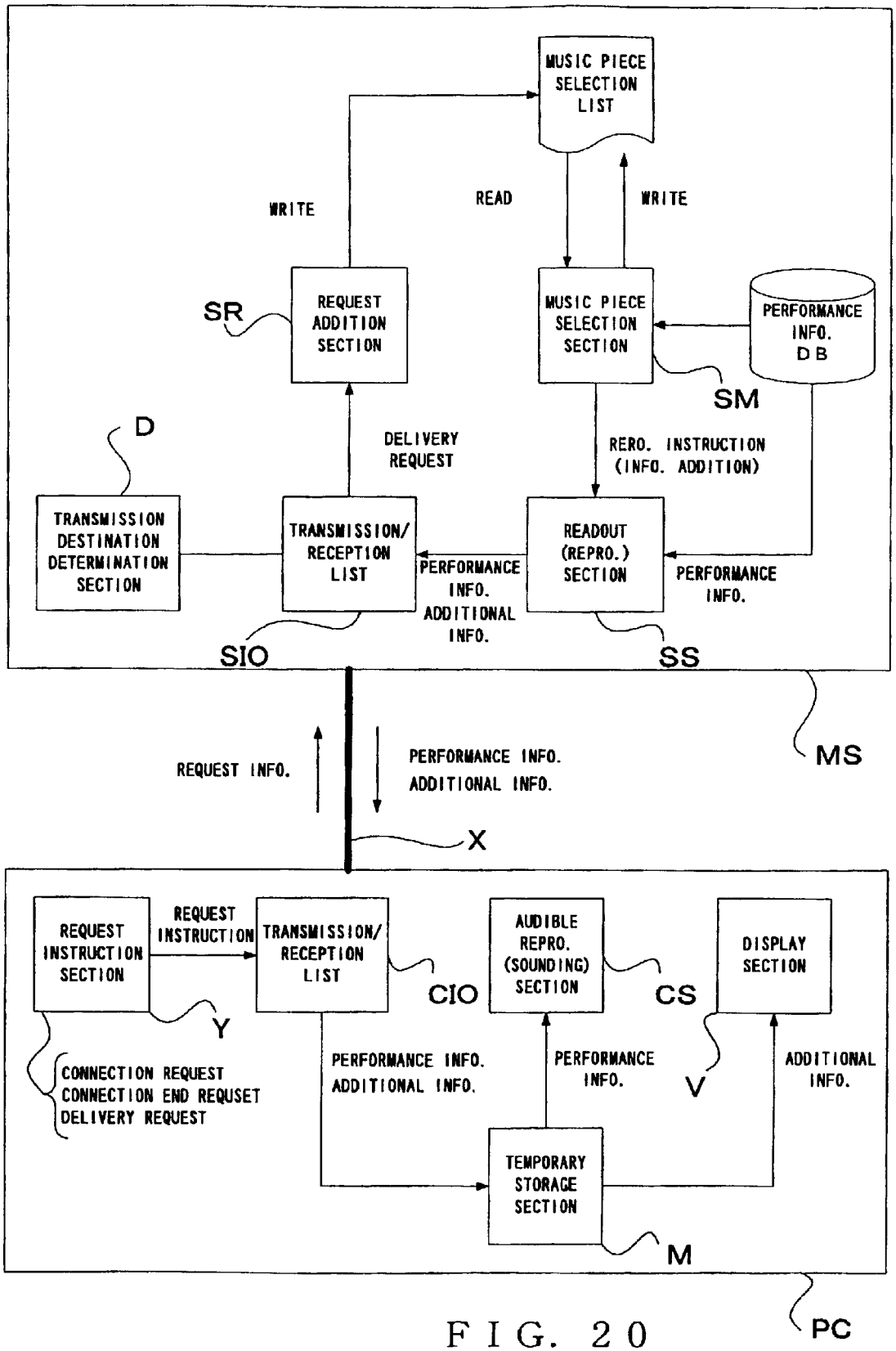
FIG. 20 is a functional block diagram explanatory of various functions performed by a personal computer terminal (client apparatus) and server apparatus in a third embodiment of the music piece performance information delivery system.

FIG. 20 is a functional block diagram explanatory of various functions performed by the personal computer terminal PC (client apparatus) and server apparatus MS in the third embodiment of the music piece performance information delivery system. Functional blocks in FIG. 20 which are imparted with the same reference characters as in FIG. 3 or 12 represent the already-described functions of FIG. 3 or 12, and hence will not be described to avoid unnecessary duplication. In the illustrated example of FIG. 20, the request instruction section Y of the personal computer terminal PC (client apparatus) can give the server apparatus MS a music piece delivery request as well as a connection request and connection end request similarly to the already-described embodiment. The music piece delivery request information includes not only music-piece-related information for specifying a user-requested music piece, such as the name of the request music piece, but also a user ID composed of a corresponding one of user-specific character string to be used for managing individual users utilizing the server apparatus MS, a transmitted-from address in the form of a unique identification number previously imparted to the personal computer terminal PC to distinguish from other personal computer terminals PC connected to the communication network X, comments on the requested music piece entered by the user, etc. The temporary storage section M temporarily stores music piece performance information and additional information received from the server apparatus MS. In the third embodiment, the temporary storage section M also has a function of sending the music piece performance information to the reproduction section CS and additional information to the display section V every predetermined time. The reproduction section CS in the personal computer terminal PC has a function of reproducing the music piece performance information sent from the temporary storage section M and thereby sounding the music piece based on the music piece performance information. The display section V has a function of, on the basis of the additional information sent from the temporary storage section M, visually displaying user's comments on the user-requested music piece and the name of the user having requested the music piece.

In the server apparatus MS, the request addition section SR has a function of writing or deleting a requested music piece, user's comments, etc. to or from the music piece selection list in accordance with request information (specifically, music piece delivery request) received from the personal computer terminal PC via the transmission/reception section SIO of the server apparatus MS. The music piece selection section SM checks to see what music pieces are contained in the music piece performance information database (DB) having a multiplicity of items of music piece performance information imparted with predetermined music piece performance information IDs, and writes a new music piece (specifically, new music piece performance information ID) into the music piece selection list. Namely, when there is no music piece delivery request from the personal computer terminal PC, music pieces selected randomly by the music piece selection section SM are recorded into the music piece selection list, but when there has been given a music piece delivery request from the personal computer terminal PC, the user-requested music piece is recorded via the request addition section SR into the music piece selection list in accordance with the request acceptance order so that the requested music piece is reproduced with priority over the randomly-selected music pieces. The music piece selection list records therein music piece performance information of a predetermined number of music pieces that are to be transmitted to the personal computer terminal PC, in predetermined transmission order.

Further, the music piece selection section SM reads out the music piece selection list and, in accordance with the read-out music piece selection list, instructs the readout section SS to reproduce a predetermined music piece. The music piece selection section SM also has a function of adding predetermined information, i.e. generating and imparting additional information to the corresponding music piece performance information. The additional information includes user-entered comments on the requested music piece, name of the user having requested the music piece and user's profile such as his or her address and age, which is generated on the basis of the music piece delivery request received from the personal computer terminal PC. The music piece performance information read out by the read-out section SS and additional information generated by the music piece selection section SM is transmitted only to the personal computer terminal PC recorded in the transmission list. In this manner, the server apparatus MS reads out the music piece performance information of music pieces recorded in the music piece selection list in accordance with the transmission order designated by the music piece selection list, and the server apparatus MS transmits, to the personal computer terminal PC, the read-out music piece performance information (and additional information as well in the case where the performance information concerns a user-requested music piece). In the above-described example, the server apparatus MS is constructed to generate the additional information for each user-requested music piece. Alternatively, arrangements may be made to allow the user to make a selection as to whether or not such additional information (particularly, the user's name and profile) should be generated and imparted.

Figure 21:
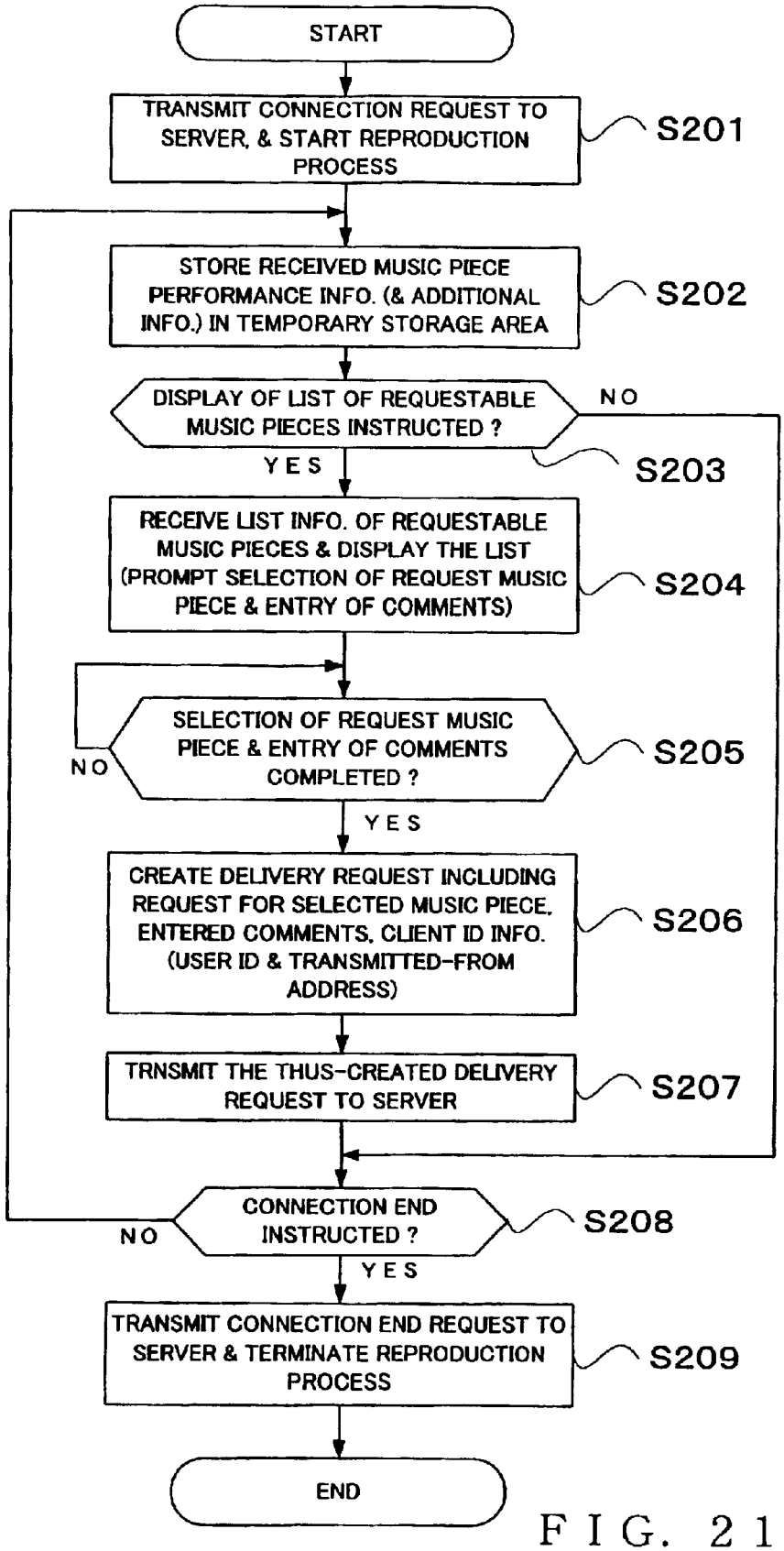
FIG. 21 is a flow chart showing an exemplary step sequence of main processing carried out by the client apparatus in the third embodiment.

This and following paragraphs describe main processing carried out by the client apparatus in the third embodiment, with reference to FIG. 21. At step S201, the CPU 1 of the client apparatus transmits request information including a connection request to the server apparatus MS having stored therein a user-desired music distributing site, and at the same time, the client apparatus starts up a reproduction process. At next step S202, music piece performance information (music piece performance information and additional information in the case where the performance information concerns a user-requested music piece) is stored in the temporary storage area.

At step S203, a determination is made as to whether or not there has been given an instruction for displaying a list of requestable music pieces. If no such instruction has been given (NO determination at step S203), the CPU 1 jumps to step S208; namely, in this case, the CPU 1 does not accept any user request. If, on the other hand, there has been given such an instruction for displaying the list of requestable music pieces (YES determination at step S203), list information representative of the list of requestable music pieces is received from the server apparatus MS, so that the list of requestable music pieces is displayed on the display device, at step S204. Specifically, the list of requestable music pieces is displayed in the following manner. For example, once a list display switch provided on the client apparatus (see a music piece reproduction screen of FIG. 24 to be later described) is activated by the user of the client apparatus, request information requesting the list information is transmitted from the client apparatus to the server apparatus MS currently connected with the client apparatus. Upon receipt of the request information requesting the list information, the server apparatus MS transmits the corresponding list information to the client apparatus. Once the client apparatus has received the list information from the server apparatus MS, it uses the received list information to display, on the display device 6A and/or the like, a request list screen including a list of music pieces which the user can request from the music distributing site (namely, a list of items of music piece performance information stored in the server apparatus MS) and a user comment entry space. By thus displaying the request list screen, the CPU 1 prompts the user to select a desired music piece from the list and enter comments on the selected music piece. Details of the request list screen will be discussed later. At step S205, a determination is made as to whether or not the music piece selection and comment entry, by the user, on the displayed request list screen have been completed. If answered in the affirmative at step S205, the CPU 1 generates, at step S206, a music piece delivery request including information about the selected request music piece, client apparatus identification information, such as entered comments, user ID, and transmitted-from address, etc., and then transmits the thus-generated music piece delivery request to the server apparatus MS at step S207.

At next step S208, a determination is made as to whether or not there has been given an instruction (connection end instruction) for terminating the connection to the server apparatus MS having stored therein the user-desired music distributing site. If no such connection end instruction has been given (NO determination at step S208), the CPU 1 of the client apparatus loops back to step S202 above to repeat the operations at steps S202 to S207. Namely, because the reception, from the user-desired music distributing site, of music piece performance information is repeated as long as the client apparatus is connected to the user-desired music distributing site (server apparatus MS), the client apparatus can play music pieces in succession, without a break, by audibly reproducing the received music piece performance information (see a reproduction process to be described later). Further, because the reception, from the user-desired music distributing site (server apparatus MS), of music piece performance information and audible reproduction of the received music piece performance information are always carried out even when the user is selecting a desired request music piece and entering his or her comments on the request list screen (see steps S203 to S207 above), the user can perform the request operation while listening to music pieces successively played on the client apparatus. If, on the other hand, the connection end instruction has been given (YES determination at step S208), the CPU 1 of the client apparatus goes to step S209 in order to transmit request information including a connection end request to the server apparatus MS and terminate the reproduction process.

Figure 22:
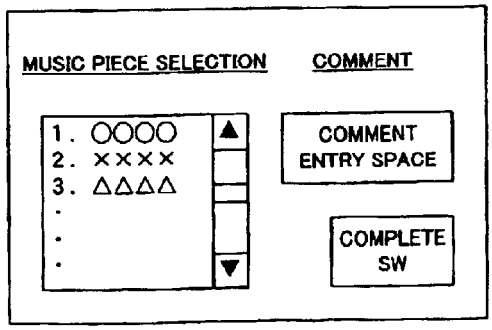
FIG. 22 is a conceptual diagram showing an example of a request list screen in the third embodiment.

Now, a brief explanation is made about the request list screen. FIG. 22 is a conceptual diagram showing an example of the request list screen, which is arranged to display, on the basis of the list information received from the server apparatus MS, the list of music pieces requestable by the user.

On the request list screen, as illustrated in FIG. 22, there are displayed a "music piece selection area" for showing the list of music pieces requestable by the user, a "comment entry area" for the user to enter his or her comments on a desired music piece in requesting the desired music piece, and a "complete" switch (SW). Specifically, the "music piece selection area" is an area for listing all music pieces requestable by the user from the user-desired music distributing site (server apparatus MS); a portion of the requestable music piece list to be actually displayed at a time in the music piece selection area can be varied vertically by user manipulation of scroll bars positioned to the right of the music piece selection area. The "comment entry area" is an area for the user, after having selected a desired music piece from the requestable music piece list displayed in the "music piece selection area", to enter comments to be displayed or sounded as the selected music piece is playing on the client apparatus. The "complete" switch is provided for the user to finalize the selection of the request music piece. Namely, once the user activates the "complete" switch after having selected a desired music piece in the "music piece selection area" and entered desired comments in the "comment entry area", the CPU 1 creates a music piece delivery request and transmits the thus-created delivery request to the server apparatus MS having stored therein the currently-accessed music distributing site (see steps S206 and S207 of FIG. 21). Namely, on the request list screen, the user can not only select a desired request music piece but also his or her enter comments on the selected request music piece.

In the above-described manner, even when the user has no idea what music pieces are requestable of the currently-accessed music distributing site (server apparatus MS), the user can readily cause the client apparatus to display the list of music pieces requestable of the music distributing site and can decide a request music piece in accordance with the displayed list, by just activating the predetermined list display switch (see the request list screen of FIG. 22). Namely, by displaying the list of requestable music pieces, the CPU 1 of the client apparatus prompts the user to select a request music piece. Also, by displaying the comment entry area to prompt the user to enter his or her comments, the user is allowed to readily enter his or her comments, such as memories of the request music piece.

Whereas the request list process has been described above as displaying only the list of requestable music pieces, it may display lists of request music pieces already accepted by the server apparatus MS, request music pieces kept waiting for acceptance by the server apparatus MS, etc. simultaneously with such a list of requestable music pieces. By so doing, the user can promptly know whether or not his or her selected request music piece has already been accepted by the server apparatus MS through a request of another user or is currently kept waiting for acceptance by the server apparatus MS; therefore, any wasteful requests can be avoided effectively.

Figures 23, 25:
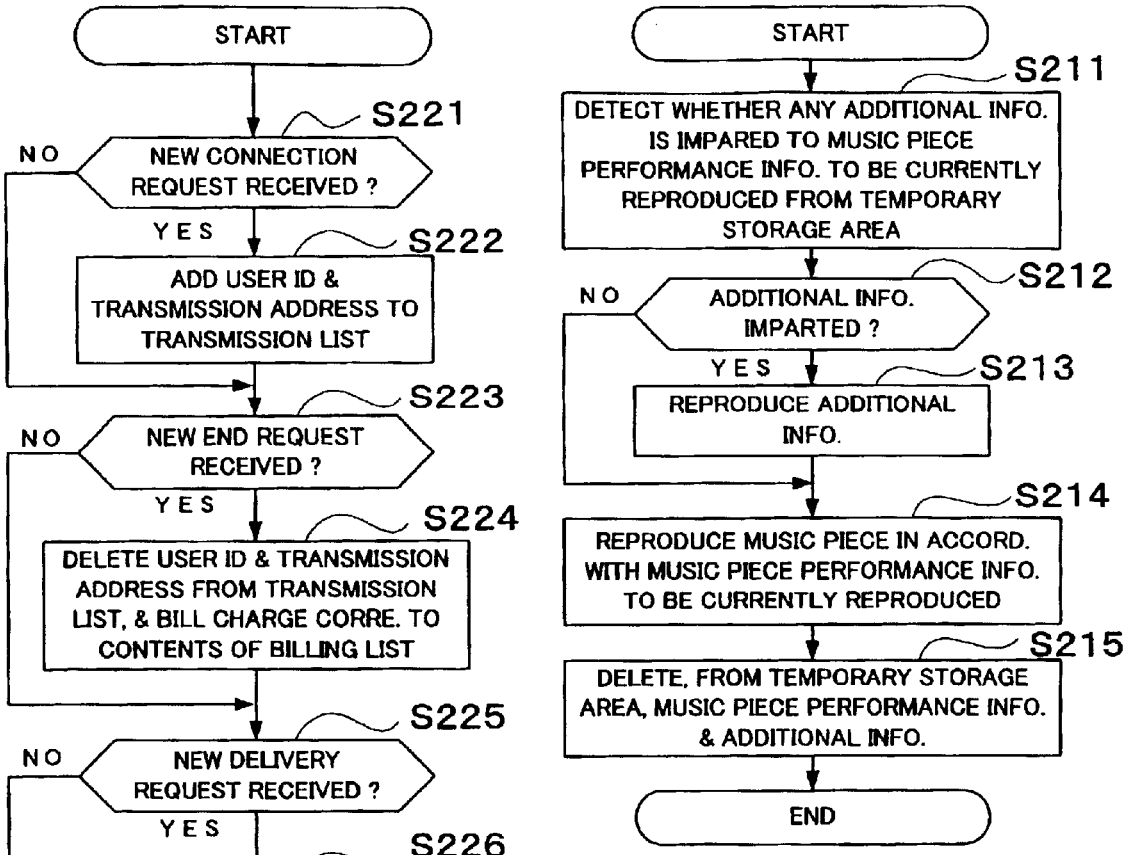
FIG. 23 is a flow chart of an example of a reproduction process carried out by the client apparatus in the third embodiment.
FIG. 25 that is a flow chart showing an exemplary step sequence of server main processing in the third embodiment.

This and following paragraphs describe the reproduction process which is started up at step S201 of the client main processing shown in FIG. 21 and brought to an end at step S209 of the client main processing. FIG. 23 is a flow chart of an example of the reproduction process carried out by the client apparatus in the third embodiment. This client reproduction process is an interrupt process activated every predetermined timing dictated by the processing clock of the client apparatus. Namely, the client reproduction process is activated interruptively during execution of the above-described client main processing per cycle of the clock pulses generated by the timer 1A shown in FIG. 2. The client reproduction process, which operates from the start instruction to end instruction given during the execution of the main processing, reads out music piece performance information received from the server apparatus MS and stored in the temporary storage area and audibly reproduces a music piece on the basis of the thus read-out music piece performance information.

First, a detection is made, at step S211, of any additional information imparted to music piece performance information to be currently reproduced from among items of music piece performance information stored in the temporary storage area, and it is determined at step S212 whether the music piece performance information to be currently reproduced has additional information imparted thereto. If the music piece performance information to be currently reproduced has additional information imparted thereto as determined at step S212, then the imparted additional information is reproduced at step S213. In reproducing the additional information, if the additional information is in the form of texts and/or images, the CPU 1 of the client apparatus displays the texts and/or images on the display device 6A, but if the additional information is in the form of sounds, the CPU 1 audibly reproduces the sounds through the sound system 7A. Note that the additional information is reproduced for a predetermined time period, e.g. until audible reproduction of the corresponding music piece is terminated or until one reproduction of the entered comments is completed. Further, the additional information may be reproduced at any suitable time, e.g. prior to initiation of the audible reproduction of the corresponding music piece or during the audible reproduction of the corresponding music piece. For example, if the additional information is in the form of sound data, it may be reproduced prior to initiation of the reproduction of the music piece and sounded between successive music pieces. If the additional information is in the form of texts and/or images, it may be reproduced during reproduction of the music piece in such a manner that the texts and/or images are displayed concurrently in parallel with the playing of the music piece. Such additional information may be reproduced at predetermined time; alternatively, information indicative of timing to reproduce the additional information may be recorded in advance so that the reproduction timing of the additional information is determined in accordance with the thus-recorded information.

At step S214, a music piece is audibly reproduced in accordance with the music piece performance information to be currently reproduced. Then, at step S215, the music piece performance information and additional information having been completely reproduced is erased from the temporary storage area. Namely, as the operation is carried out for reading out the music piece performance information stored in the temporary storage area to thereby audibly reproduce the music piece, the operation is carried out for erasing, from the temporary storage area, part of the music piece performance information corresponding to a performance section of the music piece having already been reproduced. In the case of the streaming delivery, new music piece performance information, having been received from the server apparatus MS in predetermined data units, is sequentially accumulated into the temporary storage area (see step S202 of FIG. 21), and the music piece performance information corresponding to a performance section of the music piece having already been reproduced is sequentially deleted, data unit by data unit, from the temporary storage area. Thus, even when the amount of the music piece performance information delivered from the server apparatus MS has increased significantly, the increase in the music piece performance information stored in the temporary storage area can be reliably limited to a given amount. It should be appreciated that the music pieces to be audibly reproduced here may be those based on either audio data or MIDI data. In other words, the music piece performance information may be in any data recording format, such as the audio data or MIDI data format, as long as it can be used to audibly reproduce a music piece. Furthermore, the music piece performance information may be reproduced via any suitable scheme, such as one using the streaming delivery or downloading delivery.

Figure 24:
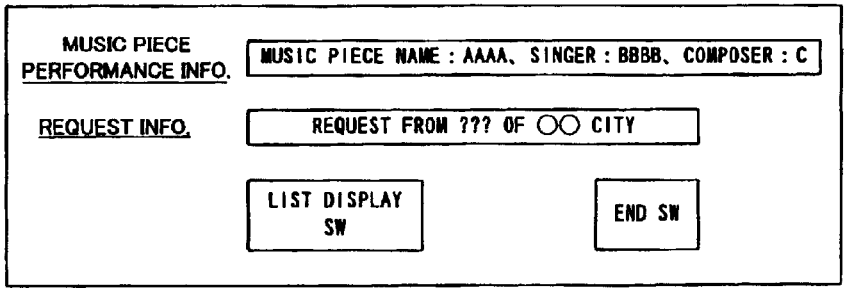
FIG. 24 is a conceptual diagram showing an example of a music piece reproduction screen in the third embodiment.

FIG. 24 is a conceptual diagram showing an example of a music piece reproduction screen, which is displayed on the client apparatus during audible reproduction of a music piece based on music piece performance information received from the server apparatus MS. Namely, as long as music pieces are played in succession on the client apparatus, the music piece reproduction screen is displayed on the display device.

On the music piece reproduction screen, as illustratively shown in FIG. 24, there are shown a "music piece information" area, a "request information" area, a "list display" switch (SW), and an "end" switch (SW). The "music piece information" area is for displaying predetermined information about a music piece being currently reproduced on the client apparatus. In the illustrated example of FIG. 24, music piece name "AAAA", singer name "BBBB", composer name "C . . . ", etc. are displayed as the information about each music piece being reproduced. The "request information" area is for displaying predetermined information about a user having requested the music piece in the case where the music piece being now reproduced has been selected by a user's request. Namely, if the additional information received from the server apparatus MS is in the form of texts and/or images, the texts and/or images are displayed in the "request information" area; in the illustrated example of FIG. 24, the name and address of the requesting person, "Mr. ???" of ○○ city", are displayed as the additional information imparted to the music piece. The "list display" switch (SW) is provided for switching the music piece reproduction screen to the request list screen. Namely, when the user wants to request a music piece while listening to sequentially-reproduced music pieces, it is only necessary for the user to operate the "list display" switch (SW). Activating the "list display" switch (SW) can switch the screen to the request list screen, so that the user can readily select a request music piece using the request list screen. The "end" switch (SW) is provided for terminating the music piece reproduction. Namely, depressing the "end" switch (SW) can terminate the playing of the currently-reproduced music piece and disconnect the client terminal from the desired music distributing site (server apparatus MS), so that no music piece tones will be generated any longer after the operation of the "end switch (SW)".

The following paragraphs describe various processes carried out by the server apparatus MS in the third embodiment, with reference to FIG. 25 that is a flow chart showing an exemplary step sequence of the server main processing.

At step S212, a determination is made as to whether or not a new connection request has been received from the client apparatus. With an affirmative (YES) determination at step S212, the user ID and transmitted-from address are added to the transmission list at step S222. Namely, the CPU 1 of the server apparatus MS determines whether the client apparatus has made an access request to the server apparatus MS, and if so, the user ID and transmitted-from address are added to the transmission list. At next step S223, a determination is made as to whether or not a new connection end request has been received from the client apparatus. With an affirmative (YES) determination at step S223, the CPU 1 bills the charge, corresponding to the contents of the billing list, to the user, at step S224. Namely, the user ID and transmitted-from address added to the transmission list when the new connection request was received from the client apparatus are deleted from the transmission list when the new connection end request has been received from the client apparatus. Thus, no music piece performance information and the like will be transmitted any longer to the client apparatus of which user ID and transmitted-from address have been erased from the transmission list. The CPU 1 of the server apparatus MS also bills the charge, currently recorded in the predetermined billing list, to the user. Note that the billing list records therein, for each user ID, the charge corresponding to contents of use of the site; thus, on the basis of the billing list, the CPU 1 of the server apparatus MS bills the charge to each individual user for use of the site. The charge corresponding to the contents of use may be paid by any desired conventionally-known payment method, such as by a credit card, payment into a designated bank account, postal transfer or electronic money.

At step S225, a determination is made as to whether or not a new music piece delivery request has been received from the client apparatus. With an affirmative (YES) determination at step S225, the CPU 1 of the server apparatus MS searches the music piece selection list for the requested music piece, at step S226. At step S227, it is determined whether the requested music piece has been successfully detected from the music piece selection list. Namely, it is checked, at steps S226 and S227, whether or not the user-requested music piece is one having been registered on the music piece selection list as an already-request-accepted music piece. In the event that the requested music piece has not been successfully detected from the music piece selection list, namely, if the user-requested music piece is not one having been registered on the music piece selection list (YES determination at step S227), the current request music piece is registered at the beginning of the music piece selection list; however, if one or more other request music pieces have already been registered at the beginning of the music piece selection list, the current request music piece is registered at the end of the group of the other request music pieces. Then, the additional information is added to the thus-registered information, i.e. the music piece performance information ID indicative of the current request music piece, at step S228. At next step S229, the CPU 1 determines a charge to be billed for the request and adds the charge to the billing list of the user. Namely, various prices, such as those for the request and use of the music distributing site, are added to a corresponding one of the billing lists provided in association with various users, and the server apparatus MS collectively bills the user when the use of the music distributing site is terminated. The operation of step S229 above is directed to determining the charge to be paid by the user when his or her request has been accepted by the server apparatus MS, i.e. when the music piece performance information of the request music piece has been newly registered onto the music piece selection list. Here, in the case where the current request music piece is one having already been registered on the music piece selection list, no charge is billed to the user of the current request music piece. In such a case, the user having requested the request music piece later than another user may be informed that no charge is billed to the user. In this way, it is possible to bill each user appropriately. The charge may be determined at any other suitable time than when the request has been accepted as set forth above, such as when the request music piece has been finally reproduced. In this case, the operation of step S229 above is dispensed with, and the charge is determined by an operation of step S246 in the server reproduction process to be later described in relation to FIG. 26.

If, on the other hand, the requested music piece has been successfully detected from the music piece selection list, namely, if the user-requested music piece is one having already been accepted by the server apparatus MS (NO determination at step S227), the additional information is added to the music piece performance information ID indicative of the detected already-registered request music piece on the basis of the received music piece deliver request, at step S230. In case the detected request music piece is one having already been registered on the basis of another user's request, data based on the received music piece deliver request are added to the additional information accompanying the music piece performance information. Namely, to each already-registered item of music piece performance information can be added the additional information based on music piece deliver requests received from a plurality of users. Of course, the present invention is not so limited, and the additional information may be rewritten or modified each time a music piece deliver request is received from a user. In the above-described manner, the server apparatus MS carries out various processes in response to various requests from the client apparatus as long as the server apparatus MS is in operation, i.e. over a time period from the turning-on to turning-off of the apparatus MS.

"music-piece-selection-list editing process" carried out by the server apparatus MS in the third embodiment is similar to the "music-piece-selection-list editing process" of FIG. 16 carried out in the second embodiment.

Figure 26:
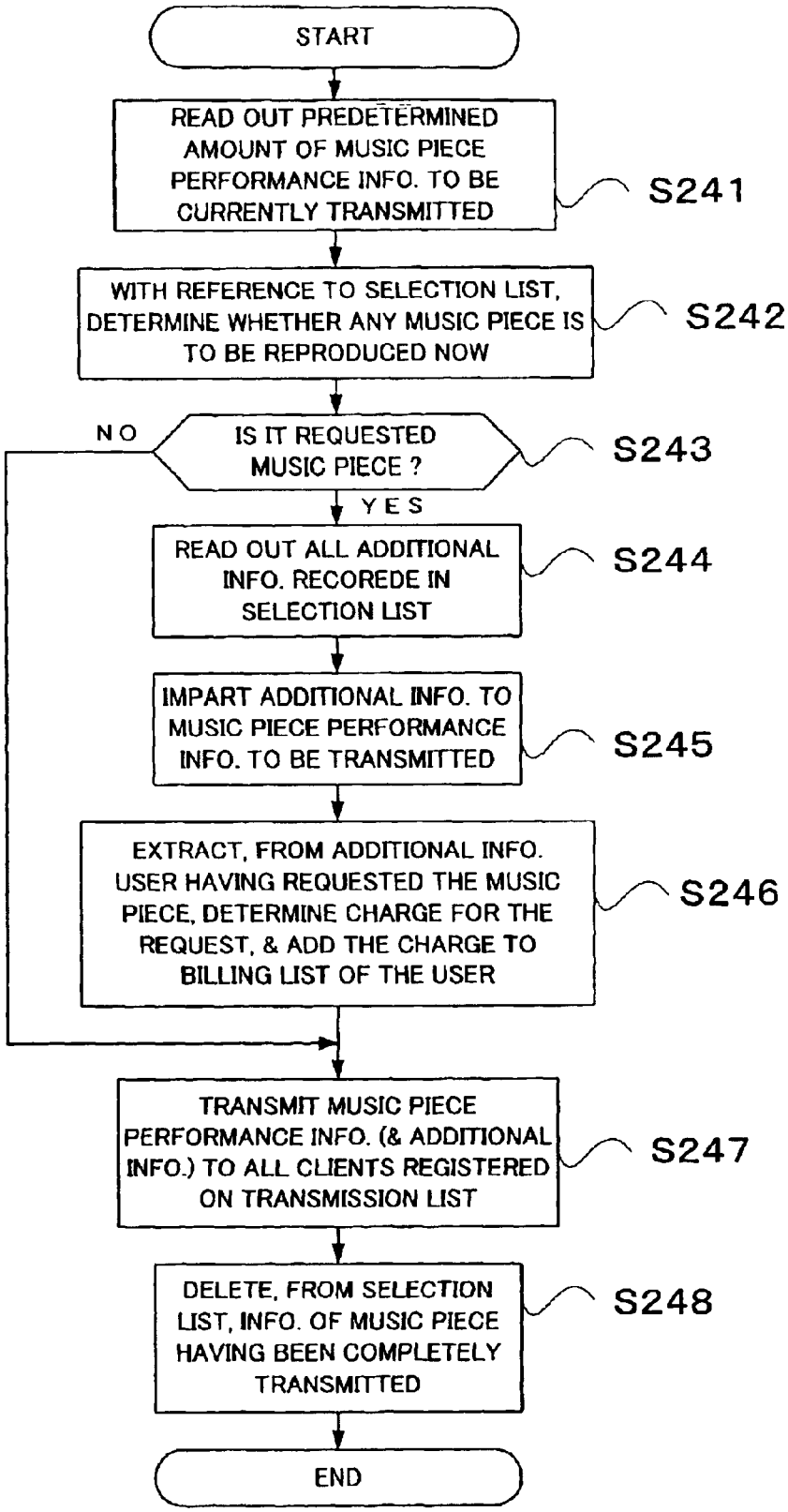
FIG. 26 is a flow chart showing an example of a reproduction process carried out by the server apparatus in the third embodiment.

Now, the reproduction process carried out by the server apparatus MS in the third embodiment is described with reference to a flow chart of FIG. 26. The server reproduction process in the third embodiment is directed to reproducing music pieces, including request music pieces, currently registered on the music piece selection list in the order the music pieces were registered (in the case of the request music pieces, in the order the requests were accepted by the server apparatus MS). The server reproduction process is activated interruptively during execution of the above-described server main processing every predetermined time; the predetermined time depends on the manner of the reproduction employed. In the case of the reproduction based on the streaming delivery, because music piece performance information is delivered from the server apparatus MS in data units each having several-minute duration, the server reproduction process is activated at time intervals corresponding to the several-minute duration. In the case of the reproduction based on the downloading delivery, because music piece performance information is delivered from the server apparatus MS in data units each representative of a single music piece, the server reproduction process is activated every such timing when the downloading can be completed before reproduction of a next music piece is initiated.

At step S241, a predetermined amount of music piece performance information to be currently transmitted is read out in the order the music pieces are currently registered on the music piece selection list. Here, the predetermined amount of music piece performance information comprises the quantity of data corresponding to the data unit of several-minute duration in the case of the streaming delivery, but comprises the quantity of data corresponding to one or more music pieces in the case of the downloading delivery. At next step S242, a determination is made with reference to the music piece selection list as to whether or not the music piece to be reproduced at the current timing is a request music piece; this determination may be made by ascertaining whether or not the performance information of the music piece to be currently reproduced has additional information imparted thereto. If the performance information of the music piece to be currently reproduced is imparted with additional information, then the CPU 1 of the server apparatus MS determines that the music piece to be currently reproduced is a request music piece. If the music piece to be currently reproduced is a request music piece (YES determination at step S243), all the additional information currently recorded in the music piece selection list is read out at step S244, and the read-out additional information is added to the music piece to be currently transmitted at step S245. Then, at step S246, every user having requested the music piece to be currently reproduced is extracted from the additional information, and a charge for the request is determined and simultaneously added to the billing list of each extracted user. Namely, the charge for the request is added to the respective billing list of every user having requested the same music piece. Namely, the operation of step S246 is directed to billing the charge for the request when the request music piece has been reproduced, rather than when the request has been accepted by the server apparatus MS (see step S229 above of FIG. 25). Namely, the operation of step S246 is executed only when the operation of step S229 above is not executed. At following step S247, the read-out music piece performance information (or the music piece performance information and additional information in the case where the performance information is imparted with the additional information) is transmitted to all the client apparatus currently registered on the transmission list; that is, the same music piece performance information is simultaneously transmitted to all the currently-registered client apparatus. Every time the transmission of the music piece performance information for a single music piece has been completed, the performance information of that music piece is erased from the music piece selection list, at step S248.

Thus, the moment the user connects the client apparatus to the server apparatus MS having stored therein a desired music distributing site, the client apparatus is allowed to automatically receive music piece performance information delivered in succession from the server apparatus MS and audibly reproduce music pieces based on the received music piece performance information. At that time, the server apparatus MS selects, with priority over music piece performance information of music pieces automatically selected thereby, music piece performance information of any user-requested music piece having been accepted by the server apparatus MS, and delivers the selected performance information of the user-requested music piece to the client apparatus. Only when there is no request music piece, the server apparatus MS delivers the music piece performance information automatically selected thereby to the client apparatus. In addition, because, in audibly reproducing the user-requested music piece, the third embodiment permits visual display of user-related information, such as comments entered by the user having requested the music piece, the user can enjoy a feeling of actually participating in broadcasting over the communication network and hence can enjoy the broadcasting without getting bored.

Alternatively, the music piece selection list may be dispensed with; in this case, when a request has been received, the server apparatus MS may read out the performance information of the request music piece from the music piece performance information database DB, while when there is no request to deal with, the server apparatus MS may directly select music piece performance information from the performance information database DB every timing when new music piece performance information is to be transmitted.

Note that when more than a predetermined number of requests have been made for a single music piece, the requests exceeding the predetermined number may be imparted with general or common information, such as "extra", as the additional information, without being imparted with user-specific additional information.

According to the above-described third embodiment, it is possible to enter additional information, such as user comments, when the user sends a request for a music piece from his or her client apparatus, such as a personal computer terminal, to a server apparatus to which the client apparatus is being connects to. Also, because the server apparatus having accepted the request delivers, with priority over other music pieces, the requested music piece along with the entered additional information, the third embodiment advantageously allows the user to enjoy the request music piece along with the additional information entered by the requestor.

It should also be appreciated that the music piece performance information to be transmitted from the server apparatus to the client apparatus may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Furthermore, where music piece performance information for a plurality of channels is handled in the present invention, the performance information may be stored together in a mixture or the performance information may be separated from each other on a track-by-track basis.

What is claimed is:

1. A server apparatus for delivering music performance information to a client apparatus connected thereto via a communication network, said client apparatus generating a connection start request when a connection to said server apparatus is to be started and also generating a connection end request when a connection to said server apparatus is to be terminated, said server apparatus comprising:

a memory storing performance information of a plurality of music pieces; and a processor coupled with said memory and adapted to:

automatically select performance information of a music piece from said memory;

upon receipt of a connection start request generated from a given client apparatus, identify said given client apparatus as a client apparatus currently connected to said server apparatus via the communication network and set the identified client apparatus as a transmission destination of performance information; and upon receipt of a connection end request generated from a given client apparatus set as a transmission destination of performance information, cancel a status, as a transmission destination of performance information, of the given client apparatus which has generated said connection end request; and deliver, via the communication network, at each timing defined by said server apparatus, same performance information selected from said memory to every client apparatus having been set as a transmission destination.

2. A server apparatus as claimed in claim 1 wherein said processor sequentially selects performance information of two or more music pieces from said memory and, in accordance with the sequential selection of the performance information from said memory, successively delivers the same performance information of two or more music pieces to a plurality of client apparatuses currently connected via the communication network to said server apparatus, and wherein successive delivery, to individual ones of the client apparatus, of the performance information of two or more music pieces is initiated at respective time points when each individual client apparatus is connected to said server apparatus.

3. A server apparatus as claimed in claim 1 wherein said processor has a music piece selection list for listing identification information of every music piece selected in accordance with a predetermined criterion, and said processor automatically selects performance information from said memory with reference to the music piece selection list.

4. A server apparatus as claimed in claim 1 wherein said processor has a transmission list for listing identification information of every client apparatus currently connected to said server apparatus via the communication network, and said processor delivers same performance information to each client apparatus with reference to the transmission list.

5. A server apparatus as claimed in claim 1 wherein said processor automatically selects performance information from said memory in such a manner as to meet a predetermined condition that a same music piece should not be repeatedly selected within a predetermined time period.

6. A server apparatus as claimed in claim 1 wherein said processor is adapted to bill a charge to each individual client apparatus connected to said server apparatus, on the basis of at least one of a total time length of the connection, to said server apparatus, of said client apparatus and a total number of music pieces delivered from said server apparatus to said client apparatus.

7. A server apparatus as claimed in claim 6 wherein the charge is billed to each client apparatus by said processor when a purchase request has been received from said client apparatus.

8. A client apparatus capable of receiving music performance information from a server apparatus via a communication network, said client apparatus comprising:

a processor adapted to be coupled to the communication network, said processor being further adapted to:

transmit a connection start request to a desired server apparatus on the communication network and establish a connection with said desired server apparatus via the communication network;

receive performance information of two or more music pieces, in succession, from said server apparatus with which the connection has been established; and transmit a connection end request to said desired server apparatus to thereby terminate the connection with said desired server apparatus; and a reproduction device that reproduces a music performance on the basis of the performance information received from said desired server apparatus, wherein music performances are reproduced successively by said client apparatus, on the basis of performance information received from the server apparatus, over a time period from a time point when a connection of said client apparatus to the server apparatus is initiated to a time point when the connection of said client apparatus to the server apparatus is terminated; and wherein the server apparatus, upon receipt of a connection start request generated from a given client apparatus, sets the given client apparatus as a transmission destination of performance information, and upon receipt of a connection end request generated from a given client apparatus set as a transmission destination of performance information, cancels a status, as a transmission destination of performance information, of the given client apparatus which has generated said connection end request; and wherein the server apparatus delivers, at each timing defined by the server apparatus, same performance information of a music piece to every client apparatus set as a transmission destination.

9. A client apparatus as claimed in claim 8 which further comprises:

a temporary storage section that temporarily stores performance information received from a server apparatus, the performance information stored in said temporary storage section being reproduced by said reproduction device and then erased from said temporary storage section at predetermined timing after termination of reproduction, by said reproduction device, of the performance information;

a storage device storing performance information of music pieces; and an input section that receives a purchase request given by a user of said client apparatus when the user wants to purchase performance information of the music piece reproduced by said reproduction device, the purchase request being transmitted to said server apparatus via the communication network, wherein said processor is further adapted to perform control for rewriting the performance information of the music piece, designated by the purchase request, from said temporary storage section to said storage device.

10. A client apparatus as claimed in claim 9 wherein the performance information stored in said temporary storage section is erased, portion by portion, from said temporary storage section at predetermined timing after reproduction of the portion of the performance information is terminated, and wherein when a particular portion of the performance information of the music piece, designated by the purchase request, has already been erased from said temporary storage section, said processor re-obtains the particular portion of the performance information from said server apparatus and thereby writes, into said storage device, complete performance information of the music piece designated by the purchase request.

11. A music-performance-information delivering program for execution by a computer of a server apparatus for delivering music performance information to a client apparatus connected to said server apparatus via a communication network, said server apparatus including a memory storing performance information of a plurality of music pieces, said client apparatus generating a connection start request when a connection to said server apparatus is to be started and also generating a connection end request when a connection to said server apparatus is to be terminated, said music-performance-information delivering program comprising:

a step of automatically selecting performance information of a music piece from said memory;

a step of, upon receipt of a connection start request generated from a given client apparatus, identifying said given client apparatus as a client apparatus currently connected to said server apparatus via the communication network and setting the identified client apparatus as a transmission destination of performance information;

a step of, upon receipt of a connection end request generated from a given client apparatus set as a transmission destination of performance information, cancelling a status, as a transmission destination of performance information, of the given client apparatus which has generated said connection end request; and a step of delivering, via the communication network, at each timing defined by said server apparatus, same performance information selected from said memory to every client apparatus having been set as the transmission destination.

12. A music-performance-information reproducing program for execution by a computer of a client apparatus for receiving music performance information from a server apparatus via a communication network and reproducing the received music performance information, said music-performance-information reproducing program comprising:

a step of transmitting a connection start request to a desired server apparatus on the communication network and establishing a connection with said desired server apparatus via the communication network;

a step of receiving performance information of two or more music pieces, in succession, from said desired server apparatus with which the connection has been established; and a step of transmitting a connection end request to said desired server apparatus to thereby terminate the connection with said desired server apparatus; and a step of reproducing a music performance on the basis of the performance information received from said desired server apparatus, wherein music performances are reproduced successively by said client apparatus, on the basis of performance information received from a server apparatus, over a time period from a time point when a connection of said client apparatus to the server apparatus is initiated to a time point when the connection of said client apparatus to the server apparatus is terminated; and wherein the server apparatus, upon receipt of a connection start request generated from a given client apparatus, sets the given client apparatus as a transmission destination of performance information, and upon receipt of a connection end request generated from a given client apparatus set as a transmission destination performance information, cancels a status, as a transmission destination of performance information, of the given client apparatus which has generated said connection end request; and wherein the server apparatus delivers, at each timing defined by the server apparatus, same performance information of a music piece to every client apparatus set as a transmission destination.

13. A server apparatus for delivering music performance information to a client apparatus connected thereto via a communication network, said client apparatus generating a connection start request when a connection to said server apparatus is to be started and also generating a connection end request when a connection to said server apparatus is to be terminated, said server apparatus comprising:

a memory storing performance information of a plurality of music pieces; and a processor coupled with said memory and adapted to:

automatically select performance information of two or more music pieces from said memory;

accept a request for a music piece from a client apparatus connected to said server apparatus via the communication network;

incorporate the music piece, for which request has been accepted as a request-accepted music piece, between the automatically-selected music pieces in accordance with a predetermined priority order, and select performance information of the incorporated request-accepted music piece from said memory;

upon receipt of a connection start request generated from a given client apparatus, identify said given client apparatus as a client apparatus currently connected to said server apparatus via the communication network and set the identified client apparatus as a transmission destination of performance information;

upon receipt of a connection end request generated from a given client apparatus set as a transmission destination of performance information, cancel a status, as a transmission destination performance information, of the given client apparatus which has generated said connection end request; and deliver, via the communication network, at each timing defined by said server apparatus, same performance information of the automatically-selected performance information of two or more music pieces incorporating the performance information of the request-accepted music piece, to every client apparatus having been set as the transmission destination.

14. A server apparatus as claimed in claim 13 wherein when the performance information of a same music piece as the request-accepted music piece has already been delivered or is expected to be delivered, said processor keeps the performance information of the request-accepted music piece waiting for delivery, irrespective of the predetermined priority order, in such a manner that the performance information of the request-accepted music piece is delivered at more than a predetermined time interval from last delivery of the performance information of the same music piece.

15. A server apparatus as claimed in claim 14 wherein delivery, via said processor, of the performance information is carried out in accordance with a predetermined delivery schedule provided for delivering, in controlled order, performance information sequentially selected from said memory, and wherein said predetermined time interval is variably set in accordance with a total number of request music pieces having already been selected but remaining to be delivered.

16. A server apparatus as claimed in claim 13 wherein delivery, via said processor, of the performance information is carried out in accordance with a predetermined delivery schedule provided for delivering, in controlled order, performance information sequentially selected from said memory, and wherein when more than a predetermined number of request music pieces have already been selected but remain to be delivered, said processor is adapted to reject acceptance of any further request for a music piece.

17. A server apparatus as claimed in claim 13 wherein said processor is further adapted to bill a charge to a user of the client apparatus having requested the music piece.

18. A client apparatus capable of receiving music performance information from a server apparatus via a communication network, said client apparatus comprising:

an input section adapted to be used by a user of said client apparatus to request a desired music piece;

a processor coupled with said input section and adapted to:

transmit a connection start request to a desired server apparatus on the communication network and establish a connection with said desired server apparatus via the communication network;

transmit a request for a music piece, made via said input section, to said desired server apparatus with which the connection has been established;

receive performance information of two or more music pieces, in succession, from said desired server apparatus; and transmit a connection end request to said desired server apparatus to thereby terminate the connection with said desired server apparatus; and a reproduction device that reproduces a music performance on the basis of the performance information received from said desired server apparatus, wherein the performance information received from said desired server apparatus includes performance information of request music pieces including a music piece requested by another user, the performance information of the request music pieces having been delivered by said server apparatus with priority over other performance information, and wherein music performances are reproduced successively by said client apparatus, on the basis of performance information received from a server apparatus, over a time period from a time point when a connection of said client apparatus to the server apparatus is initiated to a time point when the connection of said client apparatus to the server apparatus is terminated; and wherein the server apparatus, upon receipt of a connection start request generated from a given client apparatus, sets the given client apparatus as a transmission destination of performance information, and upon receipt of a connection end request generated from a given client apparatus set as a transmission destination of performance information, cancels a status, as a transmission destination of performance information, of the given client apparatus which has generated said connection end request; and wherein said server apparatus delivers, via the communication network, at each timing defined by the server apparatus, same performance information including the performance information of the requested music piece, to every client apparatus having been set as the transmission destination.

19. A music-performance-information delivering program for execution by a computer of a server apparatus for delivering music performance information to a client apparatus connected to said server apparatus via a communication network, said server apparatus including a memory storing performance information of a plurality of music pieces, said client apparatus generating a connection start request when a connection to said server apparatus is to be started and also generating a connection end request when a connection to said server apparatus is to be terminated, said music-performance-information delivering program comprising:

a step of automatically selecting performance information of two or more music pieces from said memory;

a step of accepting a request for a music piece from a client apparatus connected to said server apparatus via the communication network;

a step of incorporating the music piece for which request has been accepted, as a request-accepted music piece, between the automatically-selected music pieces in accordance with a predetermined priority order, and selecting performance information of the incorporated request-accepted music piece from said memory;

a step of, upon receipt of a connection start request generated from a given client apparatus, identifying said given client apparatus as a client apparatus currently connected to said server apparatus via the communication network and setting the identified client apparatus as a transmission destination of performance information;

a step of, upon receipt of a connection end request generated from a given client apparatus set as a transmission destination of performance information, cancelling a status, as a transmission destination of performance information, of the given client apparatus which has generated said connection end request; and a step of delivering, via the communication network, at each timing defined by said server apparatus, same performance information of the automatically-selected performance information of two or more music pieces incorporating the performance information of the request-accepted music piece to every client apparatus having been set as the transmission destination.

20. A music-performance-information reproducing program for execution by a computer of a client apparatus for receiving music performance information from a server apparatus via a communication network and reproducing the received music performance information, said music-performance-information reproducing program comprising:

a step of transmitting a connection start request to a desired server apparatus on the communication network and establishing a connection with said desired server apparatus via the communication network;

a step of accepting a request for a desired music piece made by a user of said client apparatus and transmitting the accepted request for the desired music piece to said desired server apparatus with which the connection has been established;

a step of receiving performance information of two or more music pieces, in succession, from said desired server apparatus; and a step of transmitting a connection end request to said desired server apparatus to thereby terminate the connection with said desired server apparatus; and a step of reproducing a music performance on the basis of the performance information received from said desired server apparatus, wherein the performance information received from said desired server apparatus includes performance information of request music pieces including a music piece requested by another user, the performance information of the request music pieces having been delivered by said server apparatus with priority over other performance information, and wherein music performances are reproduced successively by said client apparatus, on the basis of performance information received from a server apparatus, over a time period from a time point when a connection of said client apparatus to the server apparatus is initiated to a time point when the connection of said client apparatus to the server apparatus is terminated, and wherein said server apparatus, upon receipt of a connection start request generated from a given client apparatus, sets the given client apparatus as a transmission destination of performance information, and upon receipt of a connection end request generated from a given client apparatus set as a transmission destination of performance information, cancels a status, as a transmission destination of performance information, of the given client apparatus which has generated said connection end request; and wherein said server apparatus delivers, via the communication network, at each timing defined by said server apparatus, same performance information including the performance information of the requested music piece, to every client apparatus having been set as the transmission destination.

21. A server apparatus for delivering music performance information to a client apparatus connected thereto via a communication network, said client apparatus generating a connection start request when a connection to said server is to be started and also generating a connection end request when a connection to said server apparatus is to be terminated, said server apparatus comprising:

a memory storing performance information of a plurality of music pieces; and a processor coupled with said memory and adapted to:

accept a request for a music piece and additional information of the music piece transmitted from a client apparatus connected to said server apparatus via the communication network;

select performance information of the music piece for which a request has been accepted, from said memory;

impart the additional information, having been accepted along with the request, to the selected performance information of the requested music piece;

upon receipt of a connection start request generated from a given client apparatus, identify said given client apparatus as a client apparatus currently connected to said server apparatus via the communication network and set the identified client apparatus as a transmission destination of performance information;

upon receipt of a connection end request generated from a given client apparatus set as a transmission destination of performance information, cancel a status, as a transmission destination of performance information, of the given client apparatus which has generated said connection end request; and deliver, via the communication network, at each timing defined by said server apparatus, same performance information selected from said memory and imparting said additional information thereto to every client apparatus having been set as a transmission destination.

22. A server apparatus as claimed in claim 21 wherein the additional information includes at least one of text information and sound information.

23. A server apparatus as claimed in claim 21 wherein when said processor has accepted a request for a same music piece and different additional information of the same music piece transmitted from a plurality of users, said processor imparts all of the different additional information, transmitted from the plurality of users, to the performance information of the requested music piece.

24. A server apparatus as claimed in claim 21 wherein said processor is adapted to bill a charge to a user of the client apparatus having requested the music piece.

25. A server apparatus as claimed in claim 21 wherein said processor bills the charge to the user of the client apparatus having requested the music piece, when the performance information of the requested music piece has been delivered to the client apparatus.

26. A server apparatus as claimed in claim 21 wherein said processor is further adapted to automatically select performance information of two or more music pieces from said memory, and wherein the performance information of the requested music piece, for which request has been accepted by said processor, is selected from said memory and incorporated between the automatically-selected music pieces in accordance with a predetermined priority order, and the performance information of the automatically-selected music pieces and requested music piece selected from said memory and the additional information of the requested music piece is delivered to said client apparatus.

27. A client apparatus capable of receiving music performance information from a server apparatus via a communication network, said client apparatus comprising:

an input section adapted to be used by a user of said client apparatus to request a desired music piece and enter additional information of the desired music piece; and a processor coupled with said input section and adapted to:

transmit a connection start request to a desired server apparatus on the communication network and establish a connection with said desired server apparatus via the communication network;

transmit a request for the desired music piece, made via said input section, to said desired server apparatus, along with the additional information entered via said input section;

receive performance information of two or more of music pieces, in succession, from said desired server apparatus; and transmit a connection end request to said desired server apparatus to thereby terminate the connection with said desired server apparatus;

a reproduction device that reproduces a music performance on the basis of the performance information received from said desired server apparatus; and an information presentation device that presents contents of the additional information received from said desired server apparatus, and wherein a server apparatus, upon receipt of a connection start request generated from a given client apparatus, sets the given client apparatus as a transmission destination of performance information, and upon receipt of a connection end request generated from a given client apparatus set as a transmission destination of performance information, cancels a status, as a transmission destination of performance information, of the given client apparatus which has generated said connection end request; and wherein the server apparatus delivers, via the communication network, at each timing defined by the server apparatus, same performance information and imparting the additional information thereto, to every client apparatus having been set as the transmission destination.

28. A client apparatus as claimed in claim 27 wherein when the additional information includes at least one of text information and image information, said information presentation device visually displays contents of the at least one of text information and image information, but when the additional information is in the form of sound information, said information presentation device audibly presents contents of the sound information.

29. A music-performance-information delivering program for execution by a computer of a server apparatus for delivering music performance information to a client apparatus connected to said server apparatus via a communication network, said server apparatus including a memory storing performance information of a plurality of music pieces, said client apparatus generating a connection start request when a connection to said server apparatus is to be started and also generating a connection end request when a connection to said server apparatus is to be terminated, said music-performance-information delivering program comprising:

a step of accepting a request for a music piece and additional information transmitted from a client apparatus connected to said server apparatus via the communication network;

a step of selecting performance information of the music piece, for which request has been accepted, from said memory;

a step of imparting the additional information, having been accepted along with the request, to the selected performance information of the requested music piece a step of, upon receipt of a connection start request generated from a given client apparatus, identifying said given client apparatus as a client apparatus currently connected to said server apparatus via the communication network and setting the identified client apparatus as a transmission destination of performance information;

a step of, upon receipt of a connection end request generated from a given client apparatus set as a transmission destination of performance information, cancels a status, as a transmission destination of performance information, of the given client apparatus which has generated said connection end request; and a step of delivering, via the communication network, at each timing defined by said server apparatus, same performance information selected from said memory and imparting said additional information thereto to every client apparatus having been set as the transmission destination.

30. A music-performance-information reproducing program for execution by a computer of a client apparatus for receiving music performance information from a server apparatus via a communication network and reproducing the received music performance information, said music-performance-information reproducing program comprising:

a step of transmitting a connection start request to a desired server apparatus on the communication network and establishing a connection with said desired server apparatus via the communication network;

a step of accepting a request for a desired music piece and entry of additional information corresponding to the desired music piece, made by a user of said client apparatus, and transmitting the accepted request for the desired music piece to said desired server apparatus along with the entered additional information;

a step of receiving performance information of two or more of music pieces, in succession, from said desired server apparatus;

a step of transmitting a connection end request to said desired server apparatus to thereby terminate the connection with said desired server apparatus;

a step of reproducing a music performance on the basis of the performance information received from said desired server apparatus; and a step of presenting contents of the additional information received from said desired server apparatus; and wherein a server apparatus, upon receipt of a connection start request generated from a given client apparatus, sets the given client apparatus as a transmission destination of performance information, and upon receipt of a connection end request generated from a given client apparatus set as a transmission destination of performance information, cancels a status, as a transmission destination of performance information, of the given client apparatus which has generated said connection end request; and wherein the server apparatus delivers, via the communication network, at each timing defined by the server apparatus, same performance information and imparting the additional information thereto, to every client apparatus having been set as the transmission destination.

* * * * *